US007143830B2

(12) United States Patent
Bartlett

(10) Patent No.: US 7,143,830 B2
(45) Date of Patent: Dec. 5, 2006

(54) APPARATUS AND METHOD FOR INSTALLATION OF SUBSEA WELL COMPLETION SYSTEMS

(75) Inventor: Christopher D. Bartlett, Spring, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 11/328,757

(22) Filed: Jan. 9, 2006

(65) Prior Publication Data

US 2006/0108118 A1 May 25, 2006

Related U.S. Application Data

(63) Continuation of application No. 10/646,967, filed on Aug. 22, 2003, now Pat. No. 7,063,157.

(60) Provisional application No. 60/405,364, filed on Aug. 22, 2002.

(51) Int. Cl.
*E21B 33/035* (2006.01)

(52) U.S. Cl. ..... 166/339; 166/348

(58) Field of Classification Search ..... 166/339, 166/345, 363, 348
See application file for complete search history.

(56) References Cited

U.S. PATENT DOCUMENTS 4,127,167 A 11/1978 Arendt
4,154,298 A * 5/1979 Gano ..... 166/85.5
4,460,039 A 7/1984 Knight
6,039,119 A 3/2000 Hopper et al.
6,227,300 B1 5/2001 Cunningham et al.
6,408,947 B1 6/2002 Cunningham et al.
6,715,554 B1 4/2004 Cunningham et al.
6,843,321 B1 1/2005 Carlsen
2002/0000315 A1 1/2002 Kent et al.
2002/0000322 A1 1/2002 Bartlett et al.
2002/0040782 A1 4/2002 Rytlewski et al.
2003/0146000 A1 8/2003 Dezen et al.
2004/0140124 A1 7/2004 Fenton et al.
2005/0121198 A1 6/2005 Andrews

FOREIGN PATENT DOCUMENTS

WO WO 02/20938 A1 3/2002

* cited by examiner

*Primary Examiner*—William Neuder
(74) *Attorney, Agent, or Firm*—Henry C. Query, Jr.

(57) ABSTRACT

A method for installing a subsea completion system comprises installing a conductor housing on the sea floor, landing a wellhead in the conductor housing, securing a BOP to the wellhead, landing a casing hanger in the wellhead through the BOP, connecting a tubing hanger to a THRT, landing the tubing hanger in the wellhead or the casing hanger through the BOP, installing a wireline plug in the tubing hanger production bore through the THRT, retrieving the THRT, retrieving the BOP, securing an ROSL to the christmas tree, landing the christmas tree on the wellhead, and retrieving the wireline plug from the tubing hanger production bore using the ROSL.

28 Claims, 26 Drawing Sheets

APPARATUS AND METHOD FOR INSTALLATION OF SUBSEA WELL COMPLETION SYSTEMS

This application is a continuation of U.S. patent application Ser. No. 10/646,967 filed on Aug. 22, 2003, now U.S. Pat. No. 7,063,157, which is based on U.S. Provisional Patent Application No. 60/405,364 filed on Aug. 22, 2002.

BACKGROUND OF THE INVENTION

The present invention relates to completion systems for subsea oil and gas wells, and more specifically, to an apparatus and method for installing conventional completion systems.

The installation of a conventional subsea completion system from a drilling rig typically includes the following steps: (1) install a conductor housing at the sea floor; (2) install a wellhead in the conductor housing; (3) land a blow-out preventer ("BOP") stack on the wellhead; (4) land various casing hangers and their associated casing strings in the wellhead through the BOP; (5) land a tubing hanger and its associated production tubing string in the wellhead through the BOP using a tubing hanger running tool ("THRT") suspended from a landing string; (6) install a wireline plug in the production bore of the tubing hanger through the landing string and the THRT; (7) retrieve the THRT; (8) retrieve the BOP; (9) install a christmas tree on the wellhead using an open water riser; (10) retrieve the wireline plug through the open water riser; (11) flow test the well back to the drilling rig through the open water riser; (12) retrieve the open water riser; and (13) install a tree cap on the christmas tree.

In this sequence of steps, the wireline plug is installed in the tubing hanger in step 6 in order to provide an additional barrier between the production bore and the sea when the BOP is removed in step 8. In addition, an open water riser is used to install the christmas tree in step 9 in order to provide a conduit for retrieving the wireline plug in step 10 and for flow testing the well back to the drilling rig in step 11.

Recently operators have increasingly begun flow testing the well back to a normal production facility rather than the drilling rig. This practice eliminates the need to rent well test equipment and transport it to the drilling rig during completion activities. In addition, flow testing the well back to a normal production facility does not require an open water riser. However, such a riser is still required for retrieving the wireline plug from the tubing hanger.

Open water risers are typically run from drilling rigs or similar surface facilities which are relatively expensive to rent and operate. Moreover, since open water risers are usually time consuming to deploy, any well installation step which requires the use of an open water riser will necessarily be costly. Thus, if an alternative existed for retrieving the wireline plug from the tubing hanger, the christmas tree could be installed using a cable and the open water riser could be eliminated entirely, which would result in significant cost savings for the operator. Therefore, a need exists for a means for retrieving the wireline plug from the tubing hanger which does not require the use of an open water riser.

SUMMARY OF THE INVENTION

In accordance with the present invention, therefore, a method and apparatus for installing a conventional subsea completion system are provided which eliminate the need for an open water riser. In one embodiment of the invention, the method comprising the steps of: (a) landing a tubing hanger in a wellhead; (b) installing a plug in the tubing hanger bore; (c) providing a tree adapter which comprises a production bore and a valve for controlling flow through the production bore; (d) connecting the tree adapter to the christmas tree with the production bore in alignment with the christmas tree bore; (e) connecting the christmas tree to the wellhead with the christmas tree bore in alignment with the tubing hanger bore; (f) connecting a THRT to the tree adapter; and (g) removing the plug from the tubing hanger bore through the THRT, the production bore and the christmas tree bore.

In accordance with a further aspect of the invention, the method may also comprise the steps of connecting a BOP to the wellhead prior to the step of landing the tubing hanger in the wellhead; disconnecting the BOP from the wellhead; positioning the BOP over the tree adapter and the christmas tree; lowering a lifting sling through the BOP; securing the lifting sling to at least one of the tree adapter and the christmas tree; using the lifting sling, positioning the tree adapter and the christmas tree over the wellhead; and connecting the christmas tree to the wellhead.

The use of the tree adapter to install the christmas tree offers several advantages over prior art systems. The tree adapter provides an effective barrier between the well bore and the environment during the installation process, thus eliminating the need for a riser for this purpose. In addition, the tree adapter allows the christmas tree to be deployed using cable or a drill string, both of which are significantly less expensive than using an open water riser.

These and other objects and advantages of the present invention will be made apparent from the following detailed description, with reference to the accompanying drawings. In the drawings, the same reference numbers are used to denote similar components in the various embodiments.

DETAILED DESCRIPTION OF THE PREFERRED EMBODIMENTS

Figure 1:
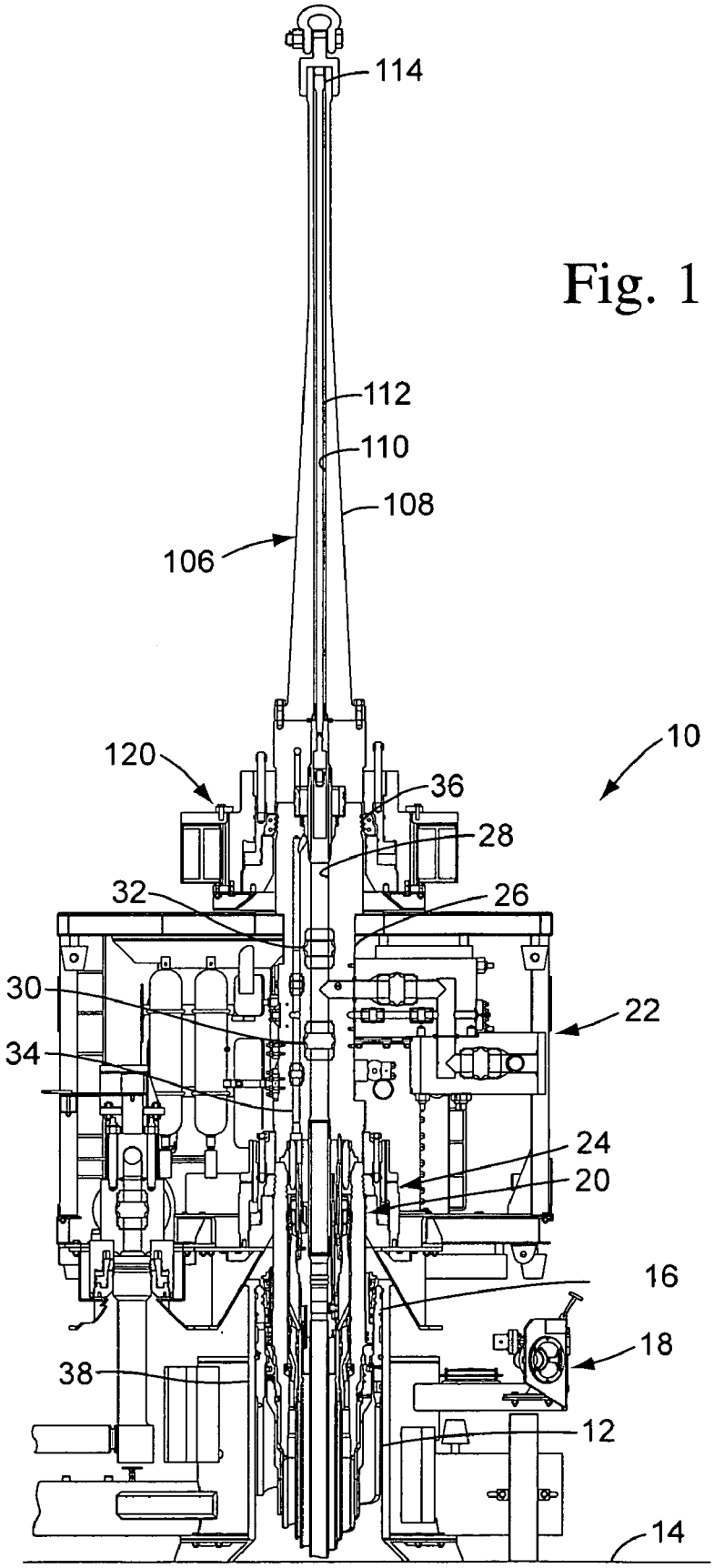
FIG. 1 is a cross sectional view of the ROSL of the present invention being used to install a christmas tree on the wellhead component of a conventional completion system in accordance with the present invention.

The apparatus and method of the present invention will be described herein in conjunction with the exemplary conventional completion system illustrated in FIG. 1, wherein certain components of the completion system are shown truncated for purposes of clarity. The conventional completion system, which is indicated generally by reference number 10, is shown to comprise a conductor pipe 12 which is installed in the sea floor 14 in the usual manner, a conductor housing 16 which is connected to the upper end of the conductor pipe, a CGB 18 which is secured to the conductor housing, a wellhead 20 which is landed in the conductor housing, and a conventional, or vertical, christmas tree 22 which is connected to the top of the wellhead using a suitable connector 24.

The illustrative christmas tree 22 comprises a tree body 26, a production bore 28 which extends generally axially through the tree body, and a number of valves, such as a production master valve 30 and a production swab valve 32, which are usually disposed in the tree body to control flow through the production bore. The christmas tree may also include an annulus bore 34 through the body 26 and a number of associated valves for controlling flow through the annulus bore. In addition, the christmas tree will typically comprise a hub profile 36 which is formed on the upper end of the tree body and via which additional components may be connected to the christmas tree.

Figure 2:
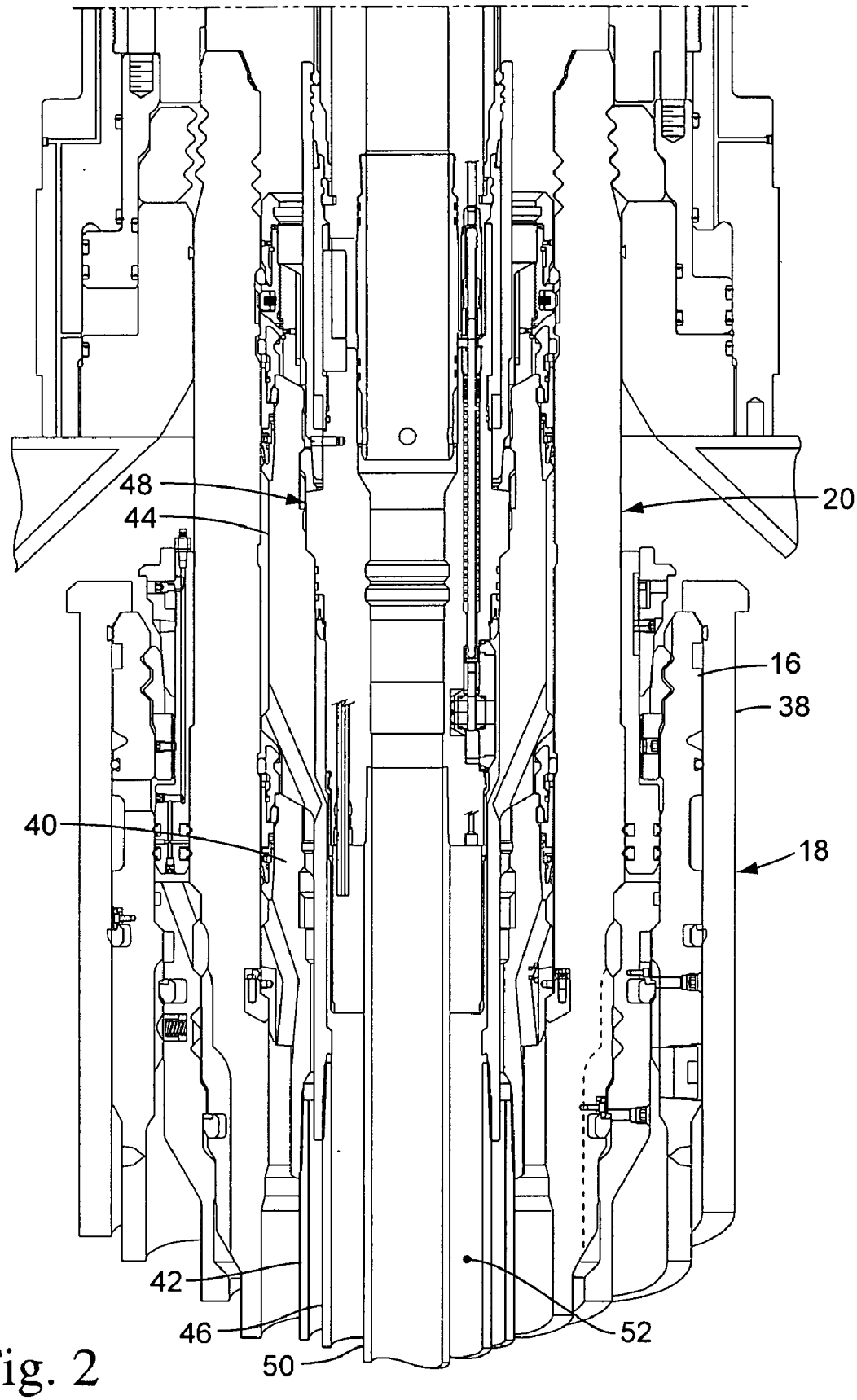
FIG. 2 is an enlarged cross sectional view of the wellhead depicted in FIG. 1, showing in particular the casing and tubing hangers of the conventional completion system.
Figure 3:
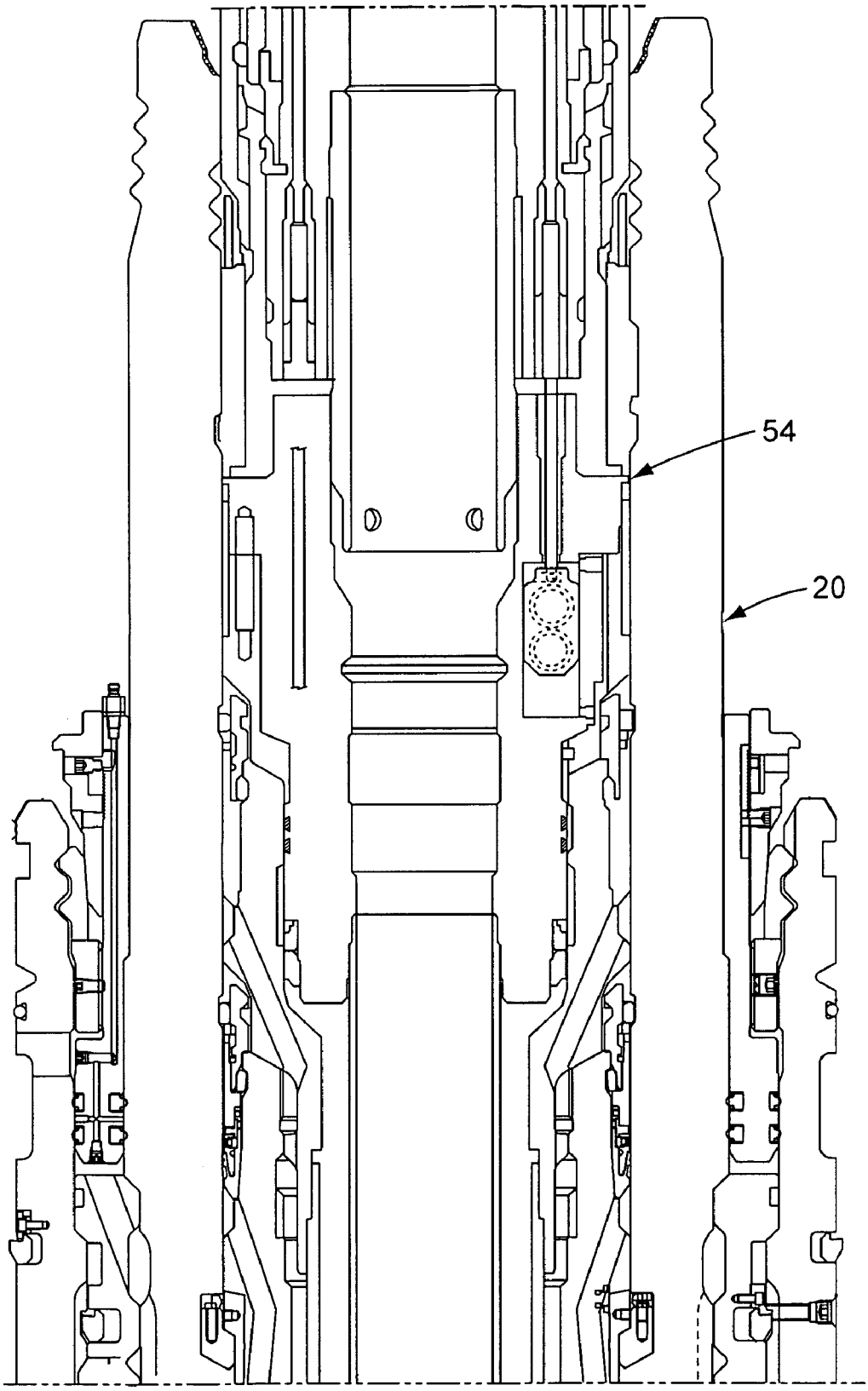
FIG. 3 is an enlarged cross sectional view of the wellhead depicted in FIG. 1 with an alternative tubing hanger.

Referring also to FIG. 2, the CGB 18 comprises an inner sleeve 38 which is mounted coaxially over the conductor housing 16 and secured thereto by suitable means. A first casing hanger 40 is connected to the top of a first casing string 42 and landed in the wellhead 20. Similarly, a second casing hanger 44 is connected to the top of a second casing string 46, which has a smaller diameter than the first casing string 42, and landed in the wellhead 20 above the first casing hanger 40. Finally, a tubing hanger 48 is connected to the top of a production tubing string 50 and landed, for example, in the second casing hanger 44. A production tubing annulus 52 is thus formed between the second casing string 46 and the production tubing string 50. As an alternative to the tubing hanger 48 shown in FIG. 2, the completion system 10 could comprise the full bore tubing hanger 54 shown in FIG. 3, which spans the entire inner diameter of the wellhead 20.

Figure 4:
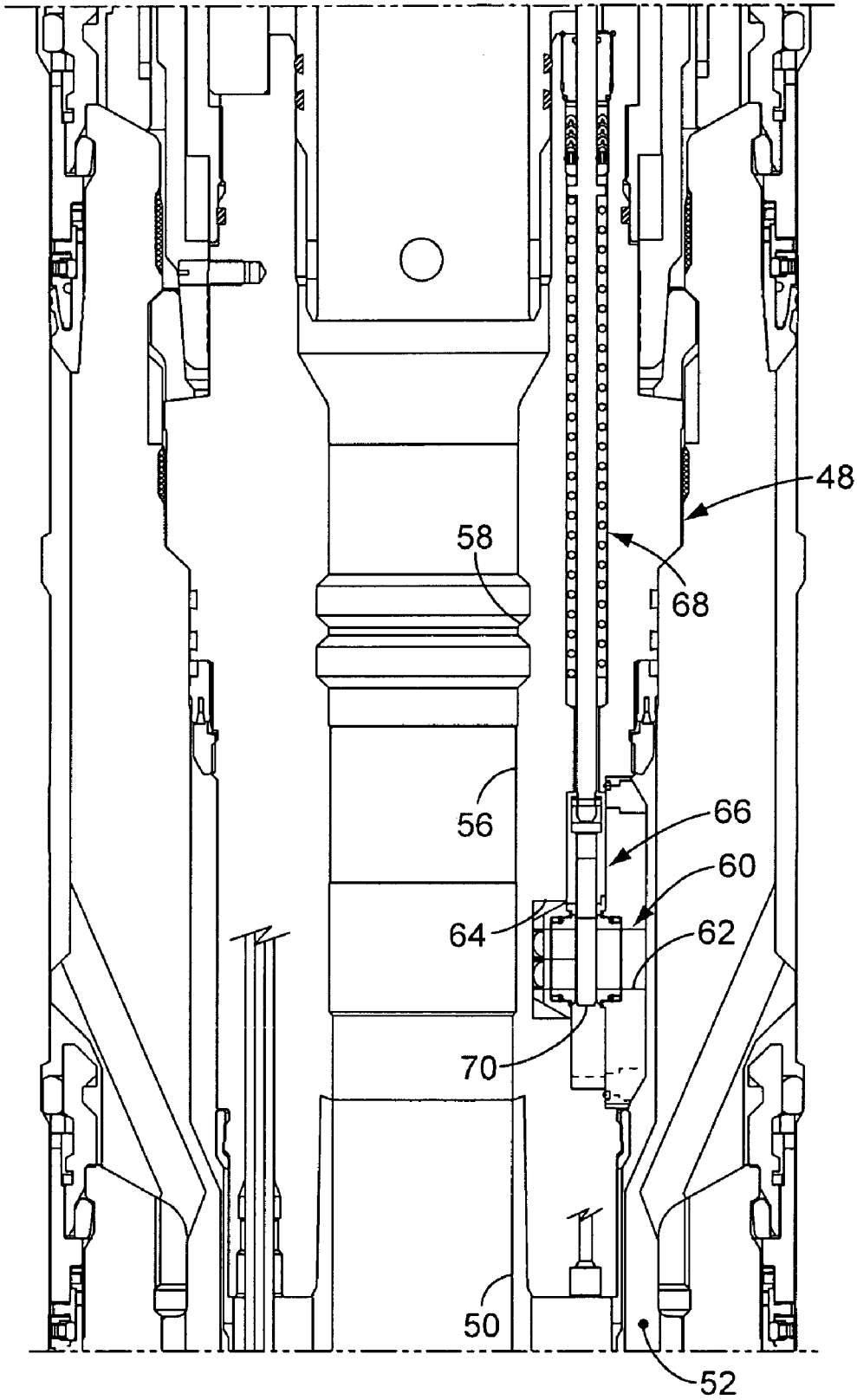
FIG. 4 is an enlarged cross sectional view of the tubing hanger shown in FIG. 1.

Referring to FIG. 4, the exemplary tubing hanger 48 is shown to comprise a production bore 56 which includes a wireline plug profile 58 for receiving a wireline plug (not shown). The tubing hanger 48 may also comprise an annulus bore 60 which extends between the production tubing annulus 52 and the top of the tubing hanger. As shown in FIG. 4, the annulus bore 60 comprises a lower lateral branch 62 which extends between the production tubing annulus 52 and a gallery 64 that in turn is fluidly connected to the top of the tubing hanger 48 by a number of longitudinal branches (not shown). The tubing hanger 48 may further comprise an annulus gate valve 66 for selectively opening and closing the annulus bore 60. In the embodiment shown in FIG. 4, the gate valve 66 includes an actuator 68 which is connected to a gate 70 that is positioned across the lateral branch 62 of the annulus bore 60. Further details of the gate valve 66, including alternative arrangements for the annulus bore 60, may be found in U.S. Pat. No. 6,494,257, which is commonly owned herewith and is hereby incorporated herein by reference.

Figure 5:
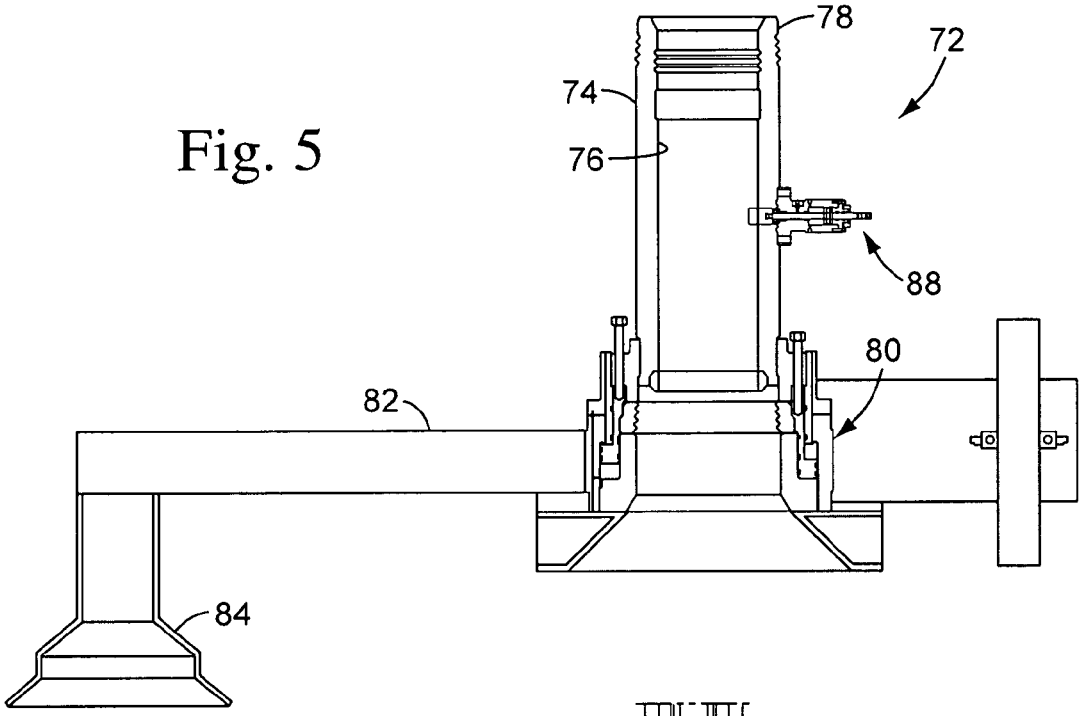
FIG. 5 is a cross sectional view of the THOT component of the present invention.
Figure 6:
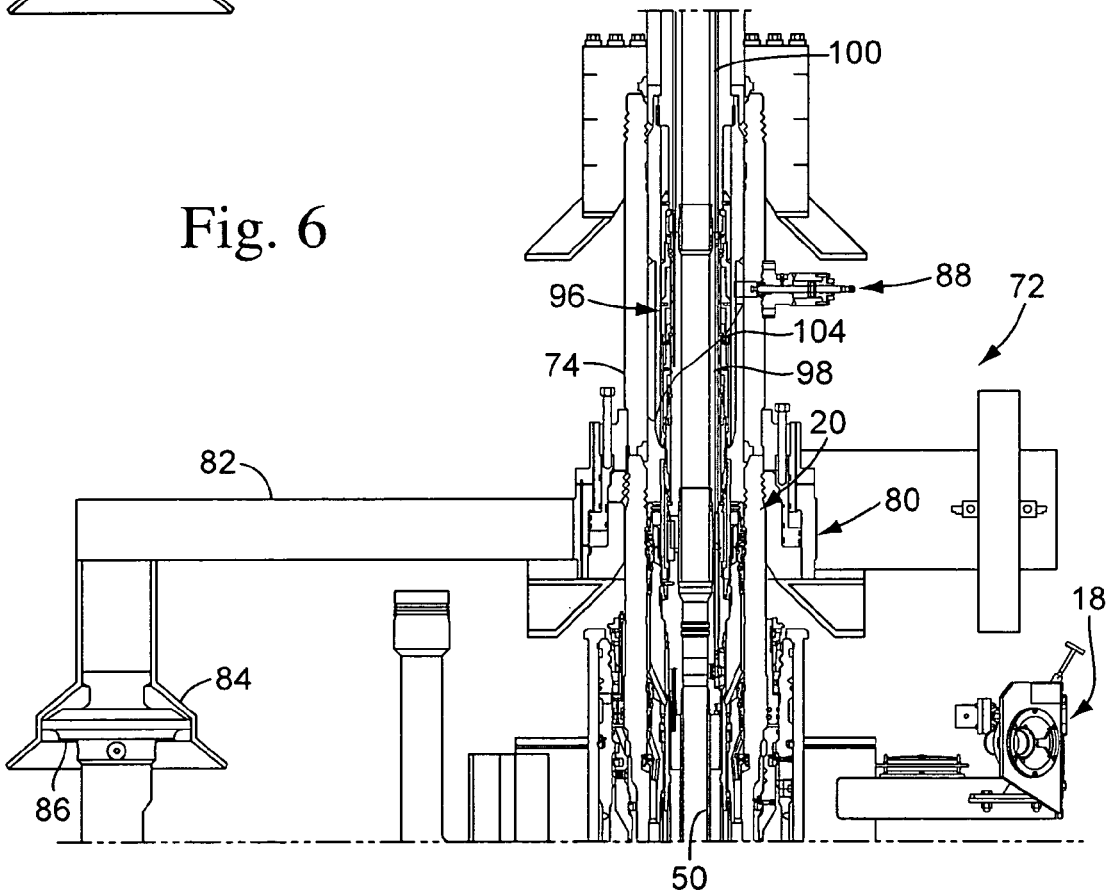
FIG. 6 is a cross sectional view of the tubing hanger of FIG. 4 being landed in the wellhead using the THRT of the present invention.

In accordance with the present invention, the tubing hanger 48 is oriented relative to the wellhead 20 using a THOT. Referring to FIGS. 5 and 6, the THOT 72 comprises a generally annular body 74, a central bore 76 which extends longitudinally through the body, a standard wellhead hub profile 78 which is formed on the upper end of the body, a connector 80 which is attached to the lower end of the body and which operates to connect the THOT to the wellhead 20 in the usual manner, and a radially extending arm 82 which includes a first end that is connected to the body or the connector and a second end which terminates in a downwardly facing guide funnel 84. The THOT 72 may be deployed on a cable or a drill pipe string with a standard wellhead running tool. As the THOT 72 is lowered onto the wellhead 20, the THOT is manipulated to align the funnel 84 with an outboard hub 86 on the CGB 18 to thereby orient the THOT relative to the CGB. It will be appreciated by those skilled in the art that other means could be used to orient the THOT to the CGB.

Figure 7:
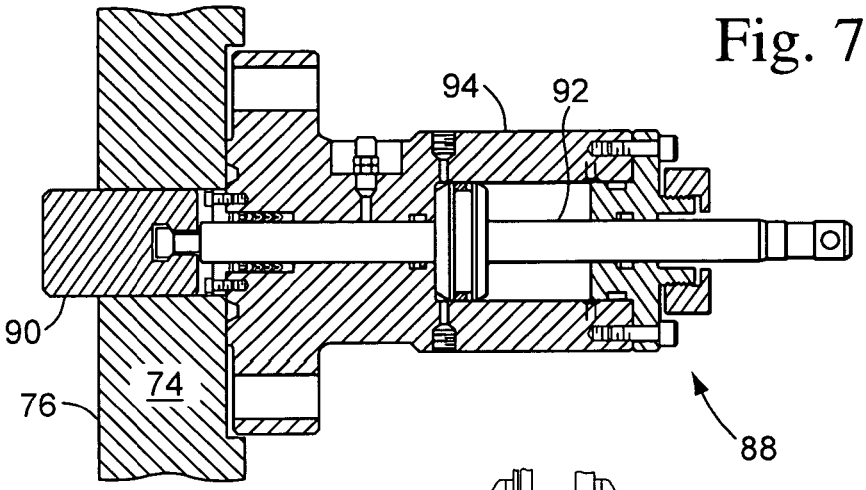
FIG. 7 is an enlarged cross sectional view of the orientation assembly of the THOT of FIG. 5.

The THOT 72 also comprises an orientation assembly 88 which is ideally mounted on the side of body 74. Referring to FIG. 7, the orientation assembly 88 comprises a retractable orientation pin 90 which can be extended into the bore 76 of the body 74. The pin 90 is mounted on a piston 92 of a hydraulic cylinder 94. Thus, the pin 90 can be selectively extended and retracted by actuating the cylinder 94.

Figure 8:
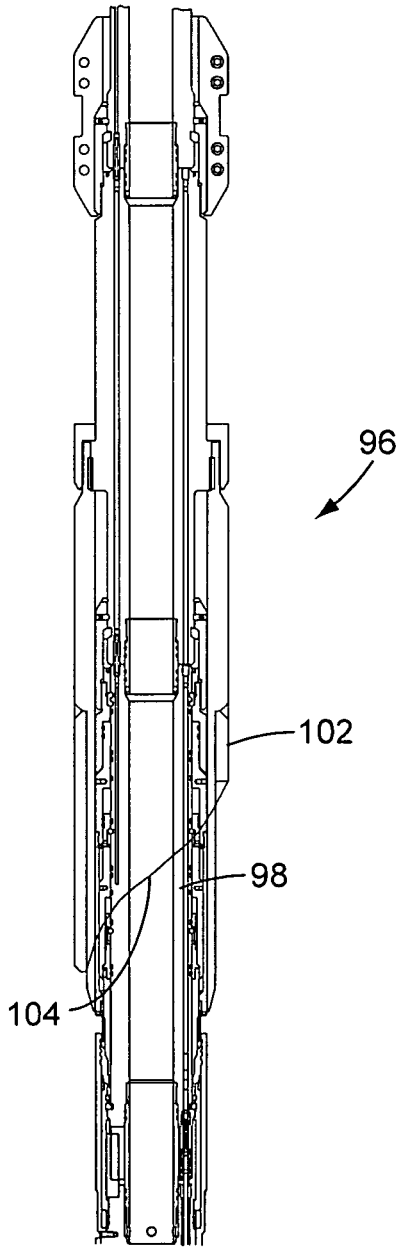
FIG. 8 is an enlarged cross sectional view of the orienting portion of the THRT shown in FIG. 6.

Referring again to FIG. 6, the tubing hanger 48 and its depending tubing string 50 are lowered through the THOT 72 and landed in the wellhead 20 using a THRT 96. Referring also to FIG. 8, the THRT 96 comprises an elongated body 98 which is connected at its lower end to the top of the tubing hanger 48 and at its upper end to, for example, a BOP spanner 100 which in turn is connected to a suitable running string (not shown). The THRT 96 also comprises an orientation sleeve 102 which includes a helix 104 that is formed on a bottom surface thereof. Alternatively, the helix 104 could be provided on the BOP spanner 100 or on a separate tool which is disposed between the THRT 96 and the BOP spanner. As the THRT 96 passes through the body 74 of THOT 72, the orientation assembly 88 is actuated to extend the orientation pin 90 into the bore 76. The helix 104 will thus engage the pin 90 and cause the THRT 96, and thus the tubing hanger 48, to rotate to the desired orientation relative to the THOT 72.

Once the tubing hanger 48 is landed in the wellhead 20, the tubing hanger production bore 56 is sealed by a wireline plug which is installed through the running string and the THRT 96. The wireline plug is often required to provide an additional barrier between the well bore and the environment until the christmas tree 22 can be installed on the wellhead 20. Thus, once the christmas tree 22 is installed, the wireline plug can be removed. In any event, the wireline plug must be removed prior to placing the completion system 10 into production.

Figure 9:
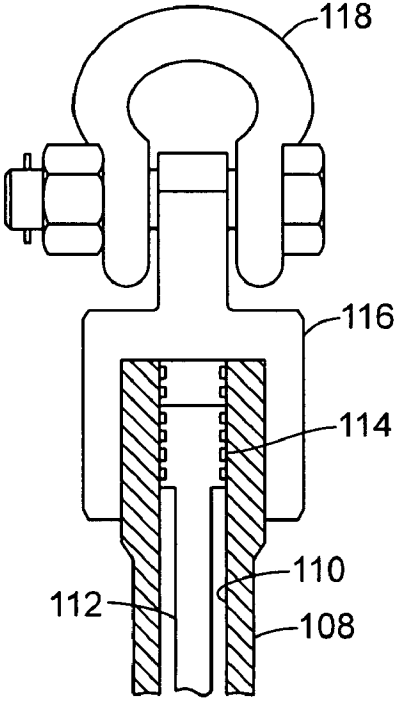
FIG. 9 is an enlarged cross sectional view of the upper end of the ROSL shown in FIG. 1.

In accordance with the present invention, therefore, the wireline plug is removed from the tubing hanger production bore 56 using a ROSL. Referring again to FIG. 1, the ROSL 106 comprises an elongated body portion 108, a bore 110 which extends longitudinally through the body portion, an elongated stem 112 which is disposed within the bore, and a piston 114 which is connected to the upper end of the stem and which sealingly engages the bore. As shown in FIG. 9, the top of the bore 110 is sealed by a cap 116, and the bore, the cap and the piston 114 define a hydraulic cylinder which is preferably actuated by an ROV (not shown). In addition, a shackle 118 or other suitable means is ideally connected to the top of the body portion 108, such as via the cap 116, to enable the ROSL 106 to be deployed by a cable. Alternatively, the upper end of the body portion 108 could be adapted to engage a drill string.

Figure 10:
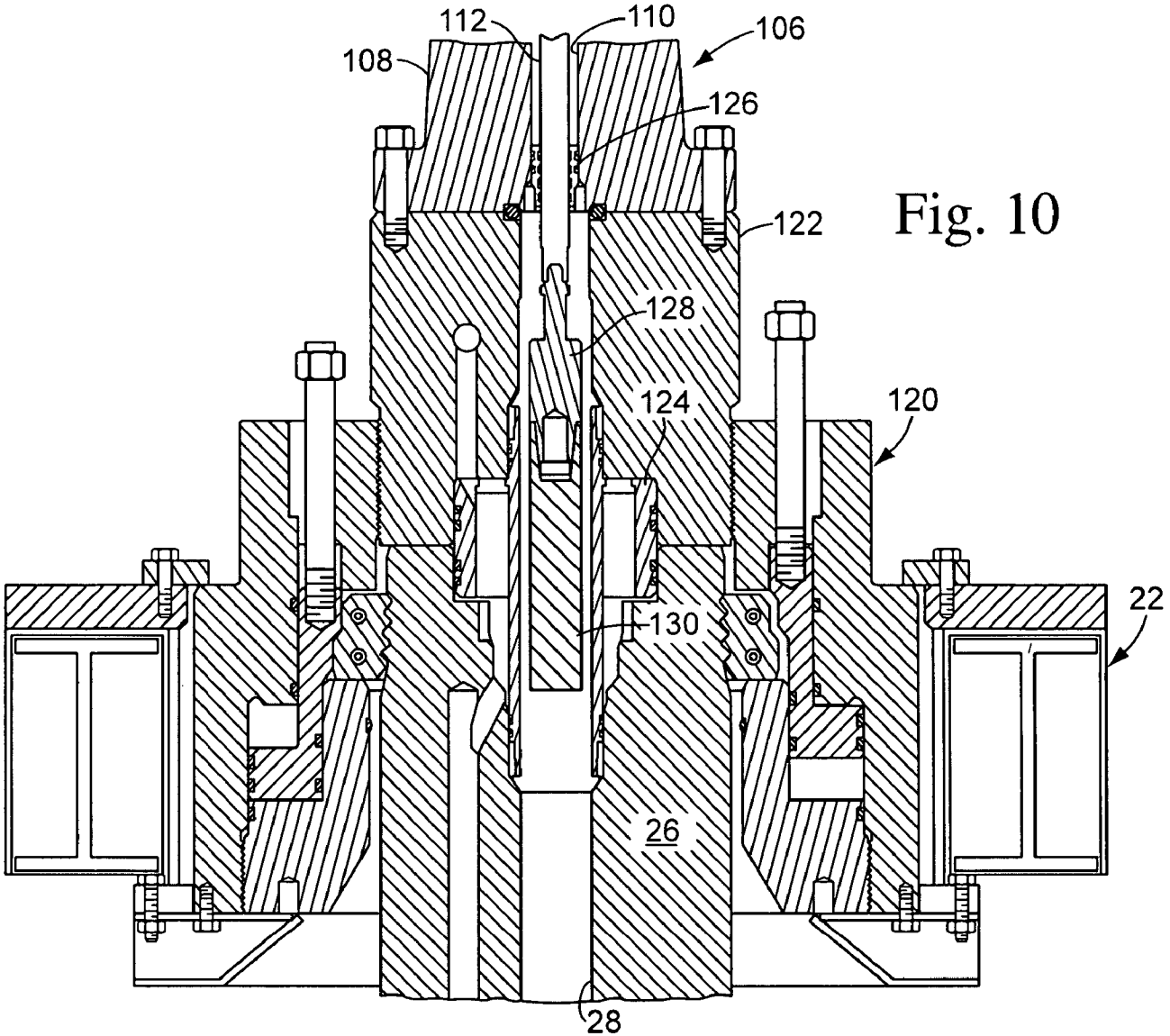
FIG. 10 is an enlarged cross sectional view of the lower end of the ROSL of FIG. 1 shown engaged with the top of the christmas tree.

Referring also to FIG. 10, the ROSL 106 is preferably secured to the top of the tree body 26 or any other desired component by a subsea connector 120 which is attached to either the bottom of the body portion 108 or an adapter 122 that in turn is connected to the bottom of the body portion. In addition, the ROSL 106 is ideally sealed to the christmas tree 22 by suitable means, such as a ring seal assembly 124 which is sealingly engaged between the tree body 26 and the body portion 108 or the adapter 122. Furthermore, the stem 112 is sealed to the bore 110 with, for example, a stuffing box 126. Thus, the ROSL provides a pressure-containing barrier between the production bore 28 and the sea. The bottom of the stem 112 extends beyond the bottom of the body portion 108 and is connected to a wireline plug running and/or retrieval tool 128 which is adapted to engage a wireline plug 130. Thus, the ROSL 106 can be used to install or remove the wireline plug 130 in or from the tubing hanger production bore 56 by extending the running and/or retrieval tool 128 completely through the christmas tree production bore 28.

The sequence of steps for installing the conventional completion system 10 in accordance with one embodiment of the present invention is illustrated in FIGS. 11A through 11M. Referring to FIG. 11A, after the conductor housing 16 is installed in the well, for example using a standard drill pipe running tool, the CGB 18 is lowered from the drilling rig and positioned with inner sleeve 38 over the conductor housing, as shown in FIG. 11B. Alternatively, the CGB 18 could be attached to the conductor housing 16 at the surface and the CGB and conductor housing run together to the well. Once the CGB is installed, flowline jumper measurements can be taken and flowline jumpers installed, if desired.

Figure 11C:
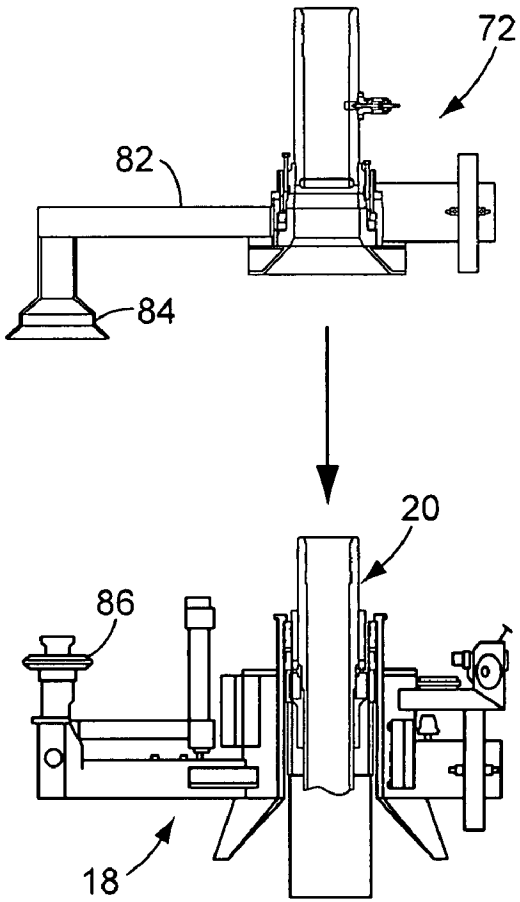
FIGS. 11A through 11M illustrate the sequence of steps for installing the subsea completion system of FIG. 1 in accordance with one embodiment of the present invention.
Figure 11B:
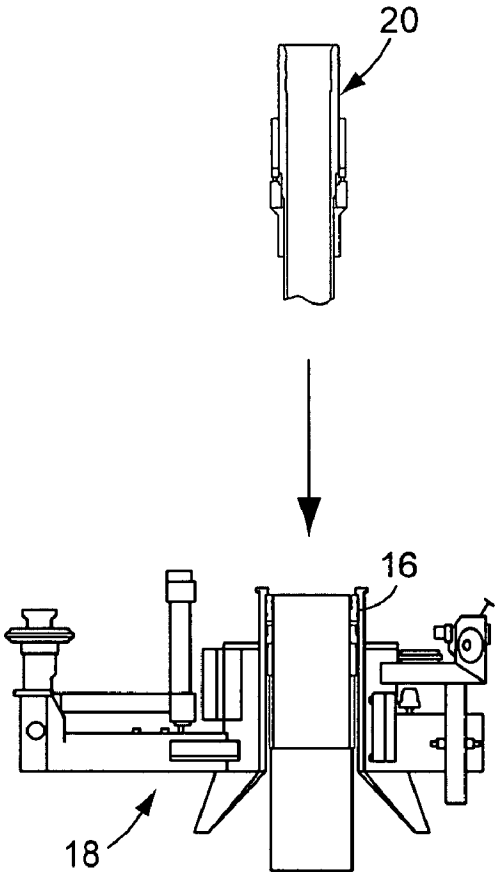
Figure 11A:
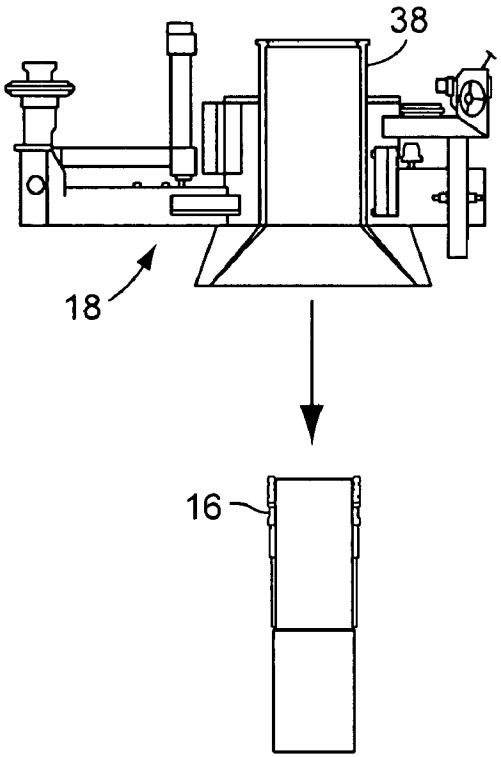

As shown in FIG. 11B and 11C, the wellhead 20 is then lowered into conductor housing 16, after which the THOT 72 is lowered to the wellhead 20. Alternatively, the THOT 72 could be attached to wellhead 20 at the surface and the THOT and wellhead run together to the well. In this case, after the wellhead 20 is landed in the conductor housing 16, the THOT 72 may need to be unlocked from the wellhead and oriented to the CGB 18 using an ROV. When landing the THOT 72, the funnel 84 is preferably oriented away from the outboard hub 86 to prevent these components from being damaged. However, to ensure that the funnel 84 and the hub 86 are not damaged during installation of the THOT 72, the radial arm 82 could be hinged so that the funnel 84 can be flipped up and out of the way. The radial arm 82 can then be flipped down by the ROV once the wellhead 20 is landed in the conductor housing 16.

Figure 11D:
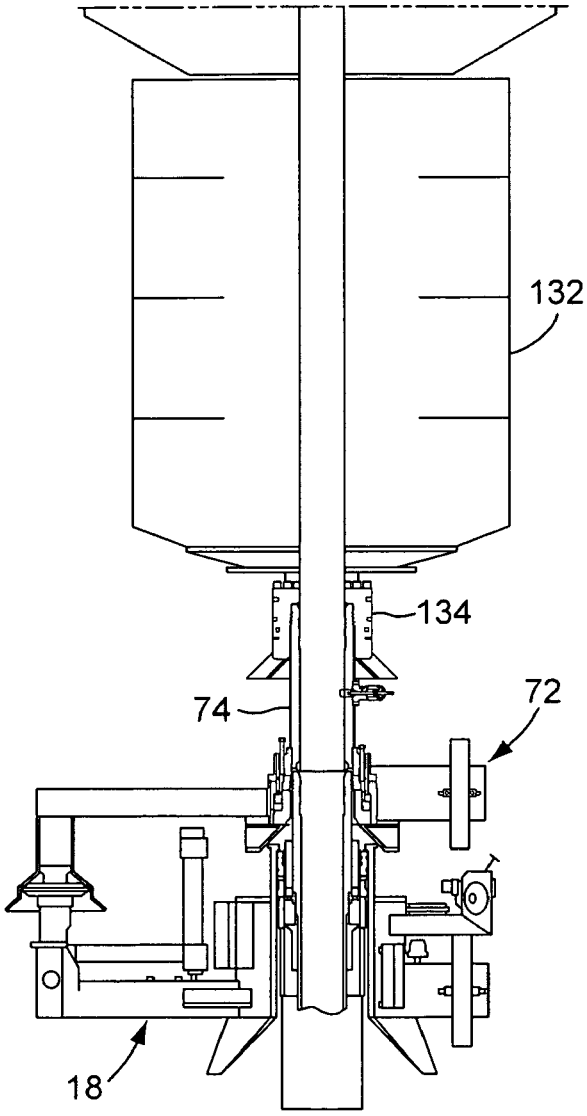

Referring to FIG. 11D, a blow-out preventer (BOP) 132 is next lowered to the well on a marine riser (not shown) and connected to the top of the body 74 of the THOT 72 via a suitable connector 134. Because the tubing hanger 48 is oriented by the THOT 72, no need exists to orient the BOP 132 relative to the wellhead 20 or the THOT. It should be noted that, where multiple wells in close proximity exist, all operations prior to this step could be performed as batch set operations. This would allow the BOP 132 to be used on multiple wells without having to retrieve it to the surface.

Figure 11E:
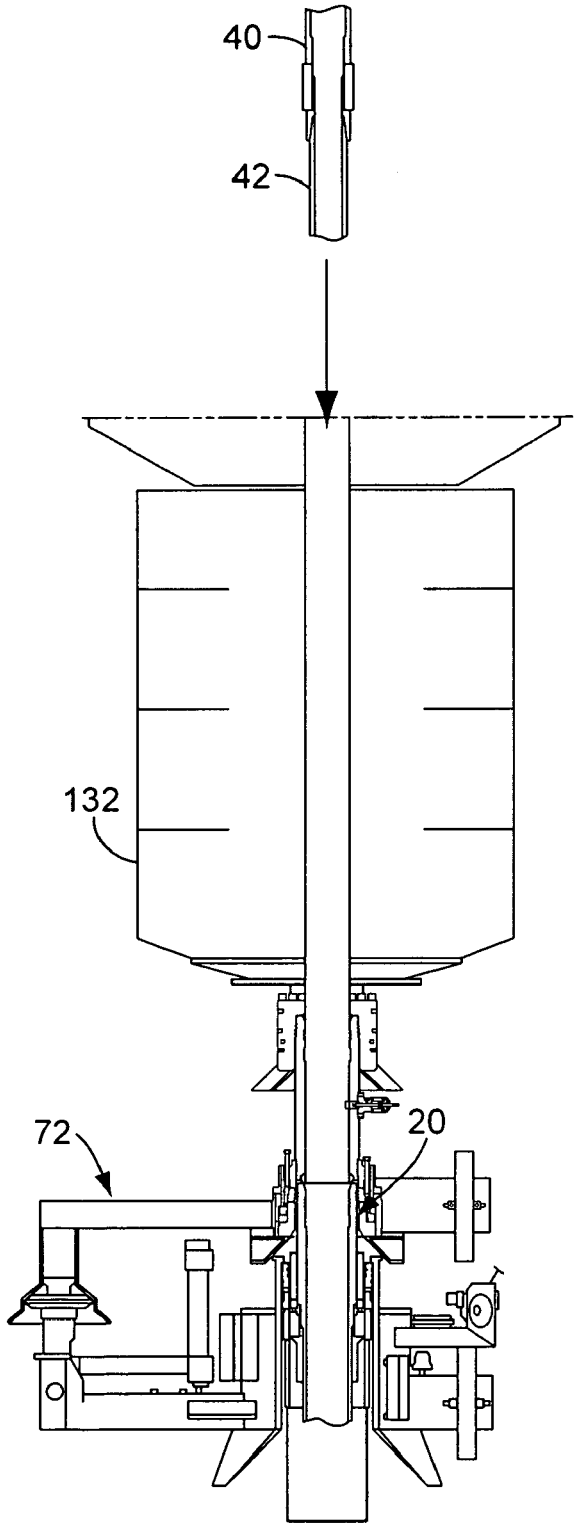
Figure 11F:
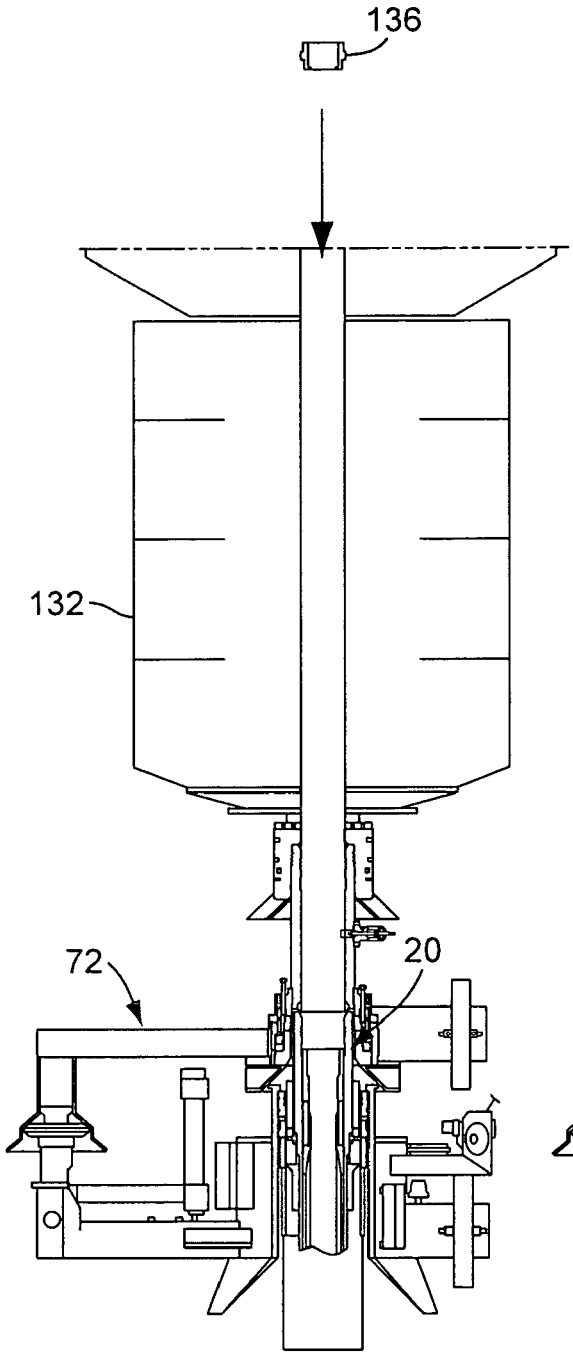

As shown in FIG. 11E, the first casing hanger 40 and its associated casing string 42 and pack-off (not shown) are then landed in the wellhead 20, preferably using standard single trip drill pipe tools. Although not illustrated, the second casing hanger 44 and its associated second casing string 46 and pack-off are then installed in the wellhead 20 in a similar manner. As will be appreciated by those skilled in the art, any number of casing hangers and associated casing strings can be installed in the wellhead 20. Referring to FIG. 11F, once all the casing hangers are installed in the wellhead 20, an optional casing hanger lockdown bushing 136 may be installed above the uppermost casing hanger using, for example, a drill pipe deployed tool. The casing hanger lockdown bushing 136 serves to lock down the casing hangers and prevent them from moving due to thermal expansion.

Figure 11G:
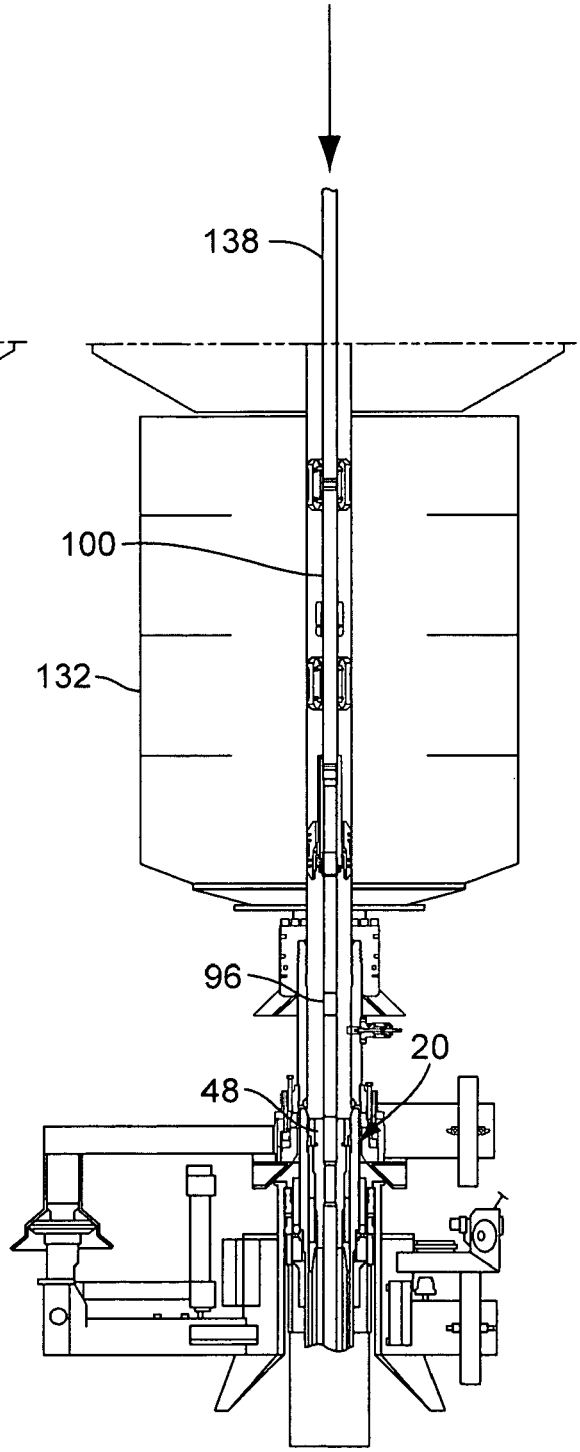

As shown in FIG. 11G, the tubing hanger 48 and its depending production tubing string 50 are next run into the well using the THRT 96. The THRT 96 is preferably suspended below the BOP spanner 100, which in turn is connected to a suitable running string 138. Once the tubing hanger 48 is landed in the wellhead 20, the wireline plug (not shown) is run though the running string 138, the BOP spanner 100, and the THRT 96 and into the tubing hanger production bore 56 to establish a barrier between the production bore and the environment. The THRT 96 is then retrieved to the surface, and the BOP 132 is either retrieved to the surface or moved laterally to another well. In either case, the steps which require the use of the drilling rig are now complete for this well. Therefore, the additional steps described below can be performed using a smaller, cheaper vessel of opportunity, thus resulting in significant savings in time and money for the operator.

Figure 11H:
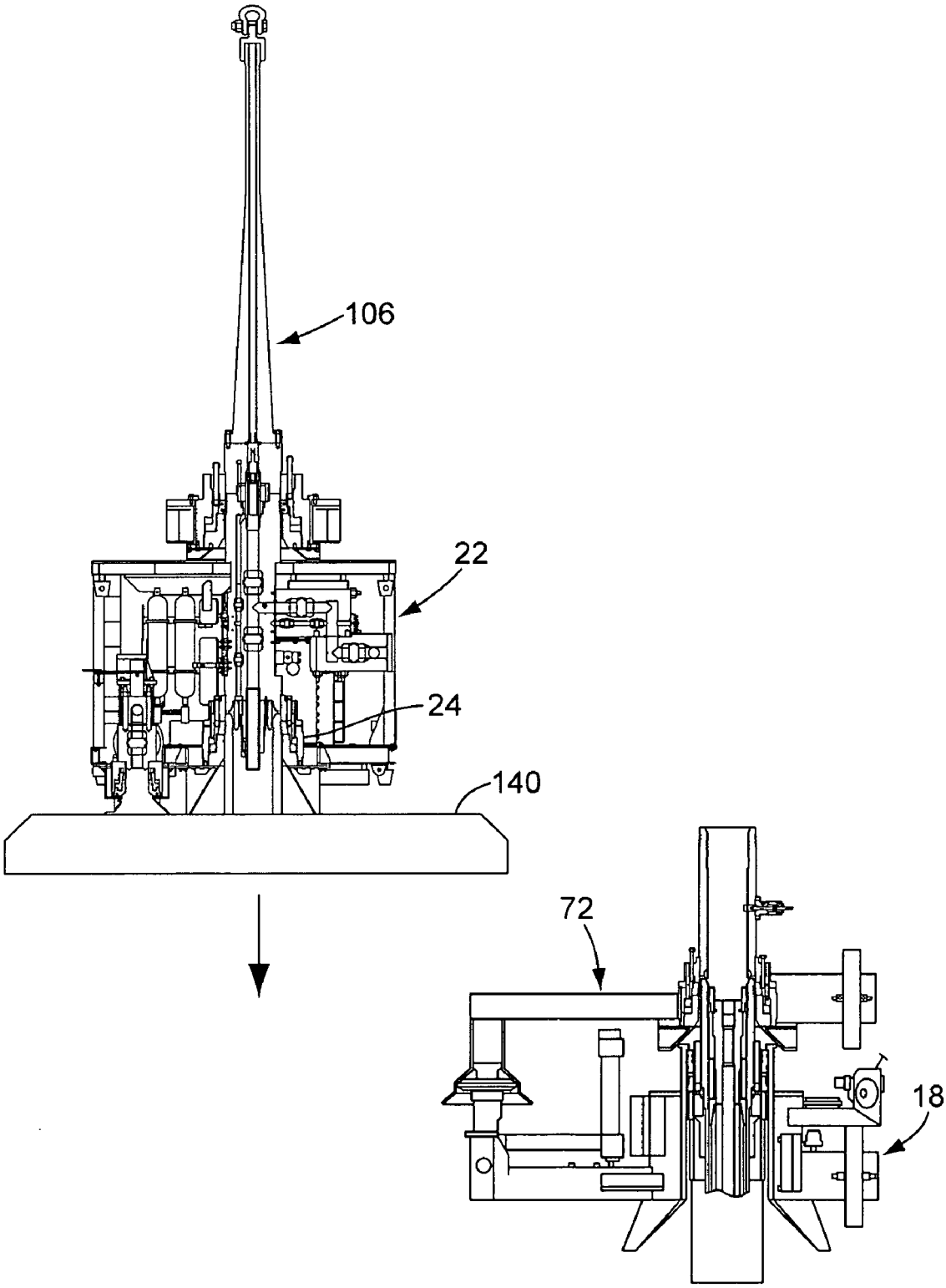
Figure 11I:
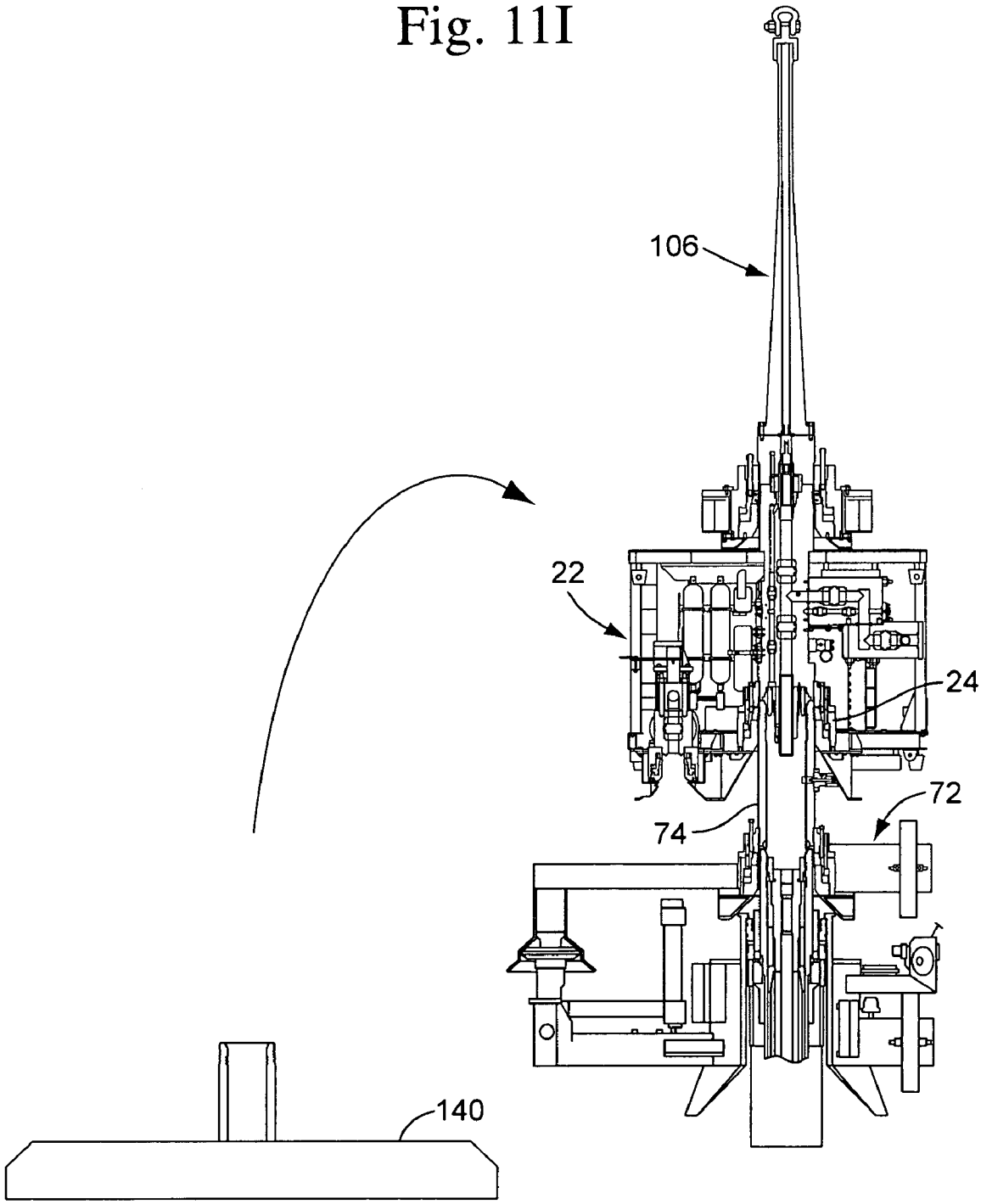
Figure 11J:
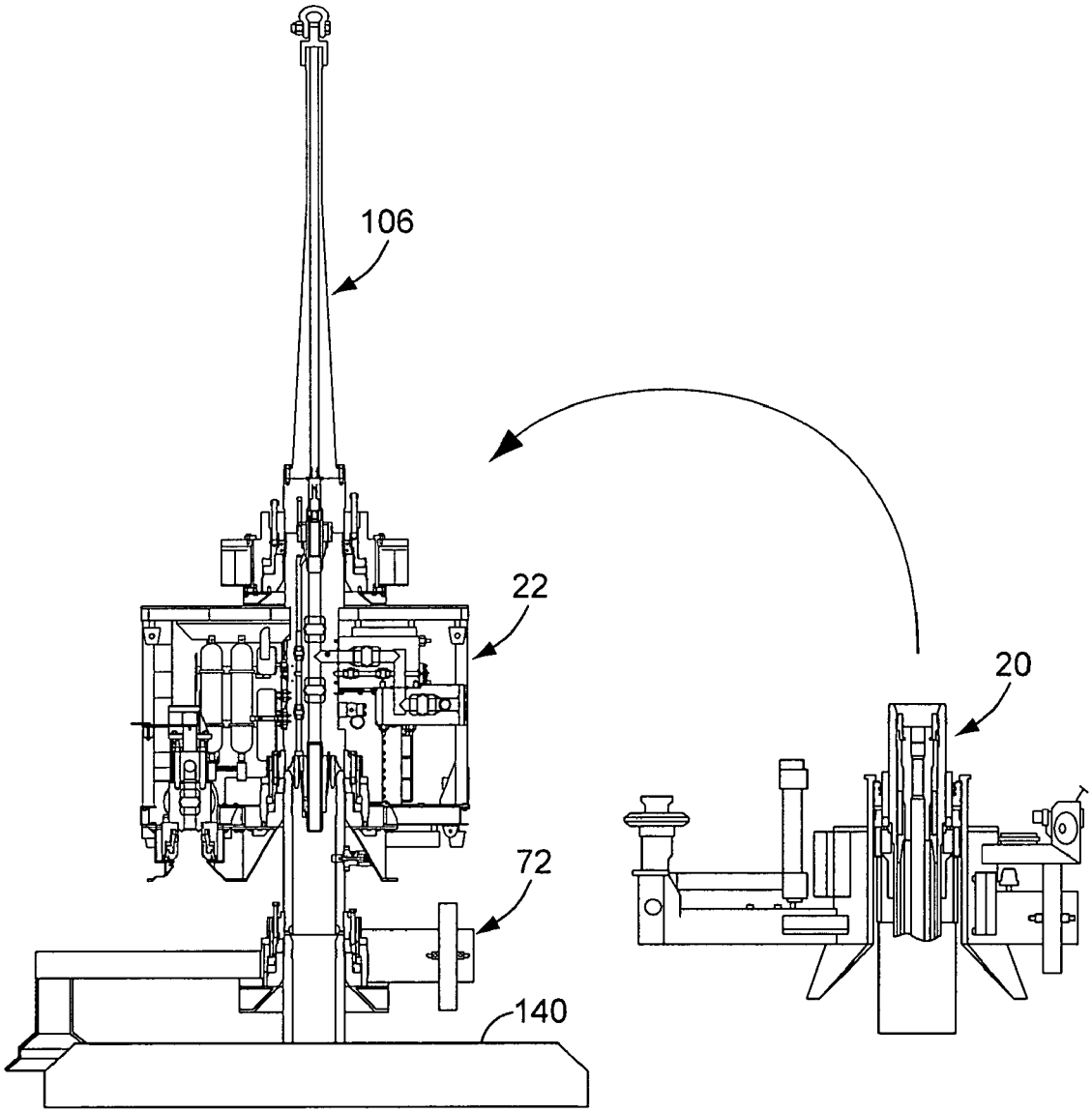

Referring to FIG. 11H, an assembly comprising a mudmat 140, the christmas tree 22 and the ROSL 106 is lowered via, for example, a cable to a location on the sea floor proximate the well. In this regard, the tree 22 is removably secured to the mudmat 140 with the connector 24. As shown in FIG. 11I, the tree 22 is then disconnected from the mudmat 140, and the ROSL 106 and the tree are moved to and lowered onto the THOT 72, after which the tree is connected to the body 74 of the THOT using the connector 24. As shown in FIG. 11J, the THOT 72 is then disconnected from the wellhead 20, and the ROSL 106, the tree 22, and the THOT are moved as a unit and landed on the mudmat 140. The THOT 72 may then be connected to the mudmat 140 with the connector 80.

Figure 11K:
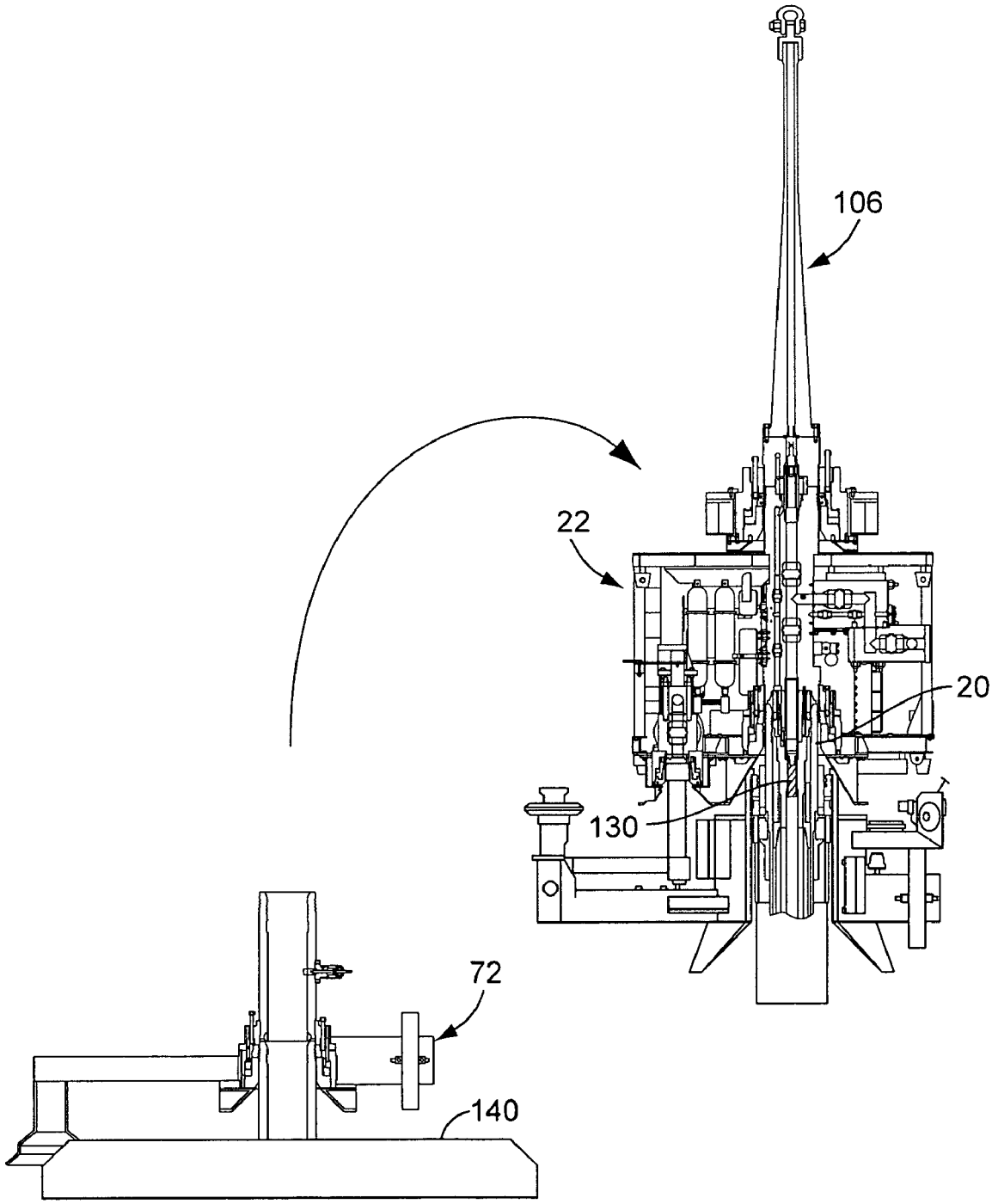

Referring to FIG. 11K, the tree 22 is then disconnected from the THOT 72, and the ROSL 106 and the tree are moved to and landed on the wellhead 20, after which the connector 24 is actuated to connect the tree to the wellhead. At this point the tree connections may be tested and the controls flying lead (not shown) may be installed. Next, the ROSL 106 is actuated to move the wireline plug installation and/or retrieval tool 128 downward through the christmas tree production bore 28 and into engagement with the wireline plug 130 in the tubing hanger production bore 56. The ROSL 106 is then actuated again to remove the wireline plug 130 from the tubing hanger production bore 56. The swab valve 32 in the christmas tree 22 may now be closed and tested. It will be appreciated by those skilled in the art that the ROSL 106 can also be landed on the christmas tree 22 and used to install the wireline plug in the tubing hanger 48 during workover operations.

Figure 11L:
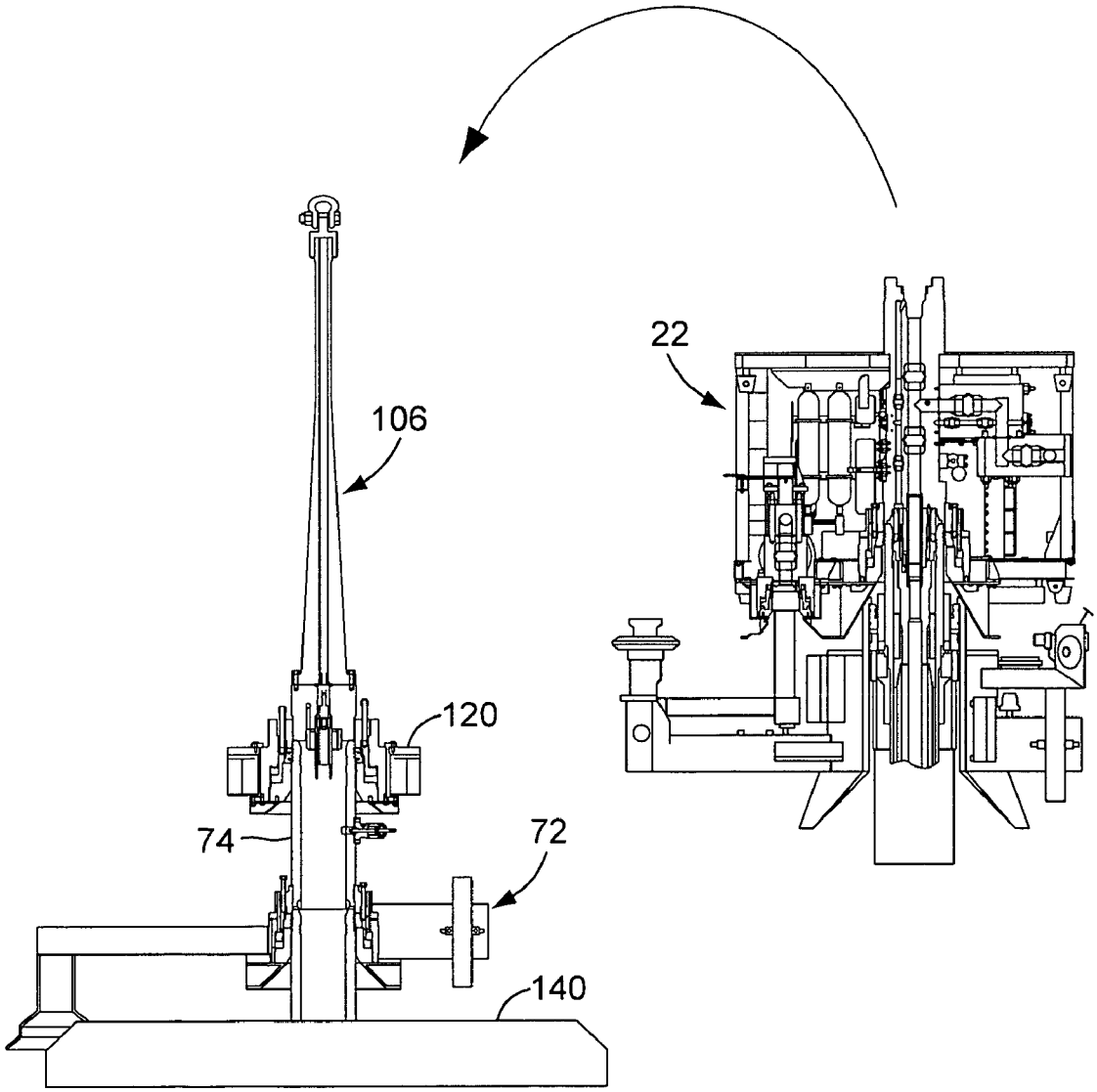

Referring to FIG. 11L, the ROSL 106 is next disconnected from the tree 22 and moved to the mudmat 140. The ROSL 106 may then be connected to the body 74 of the THOT 72 by actuating the connector 120. Ideally, a tree cap (not shown) is then installed on the tree 22, preferably using an ROV. The well may now be flow tested back to the normal production facility.

Figure 11M:
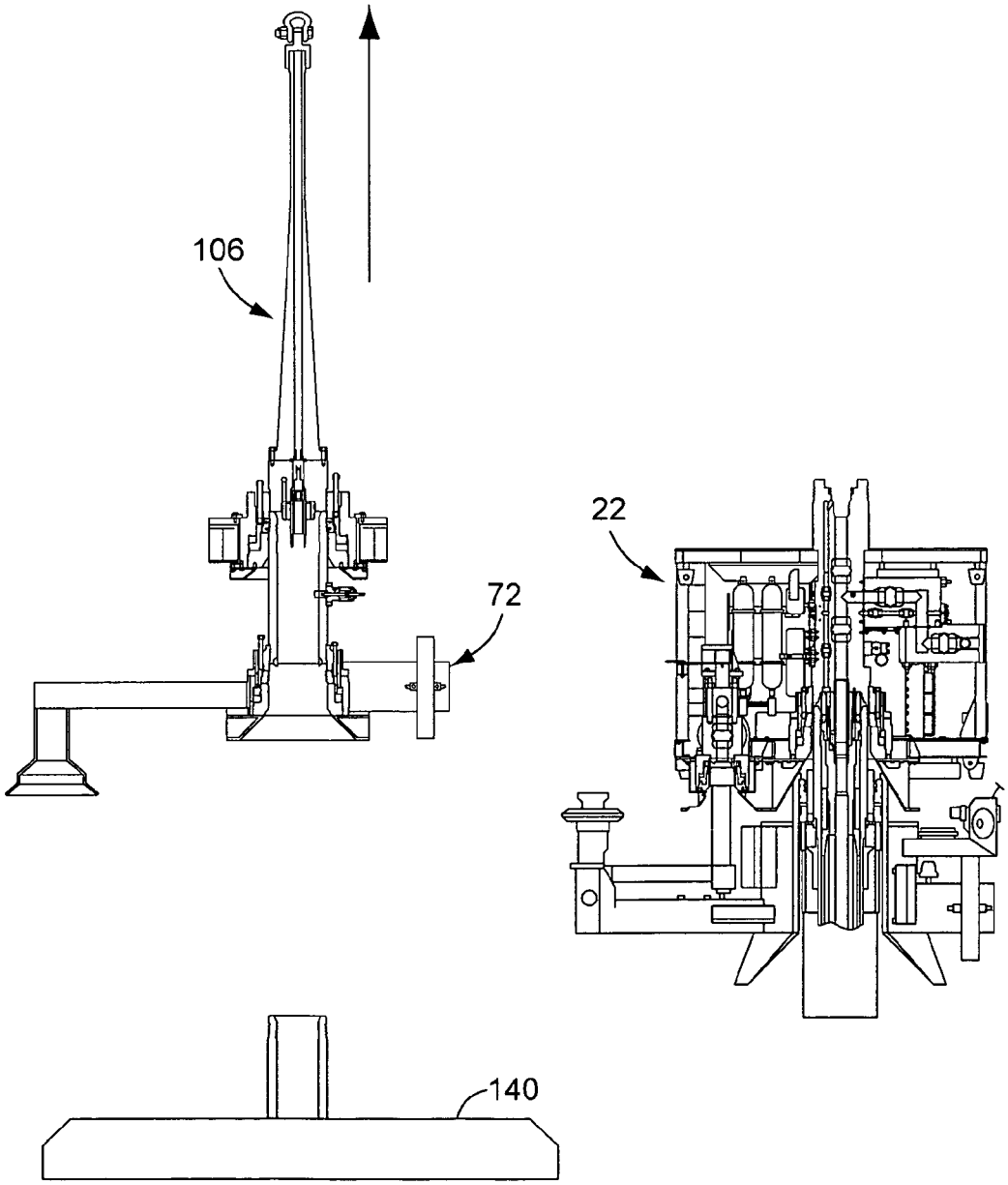

Referring to FIG. 11M, the THOT 72 is subsequently disconnected from the mudmat 140, and the ROSL 106 and the THOT are either retrieved back to the surface or moved to another well. If desired, the THOT 72 and the mudmat 140 could remain connected together and the mudmat also retrieved or moved.

Figure 12A:
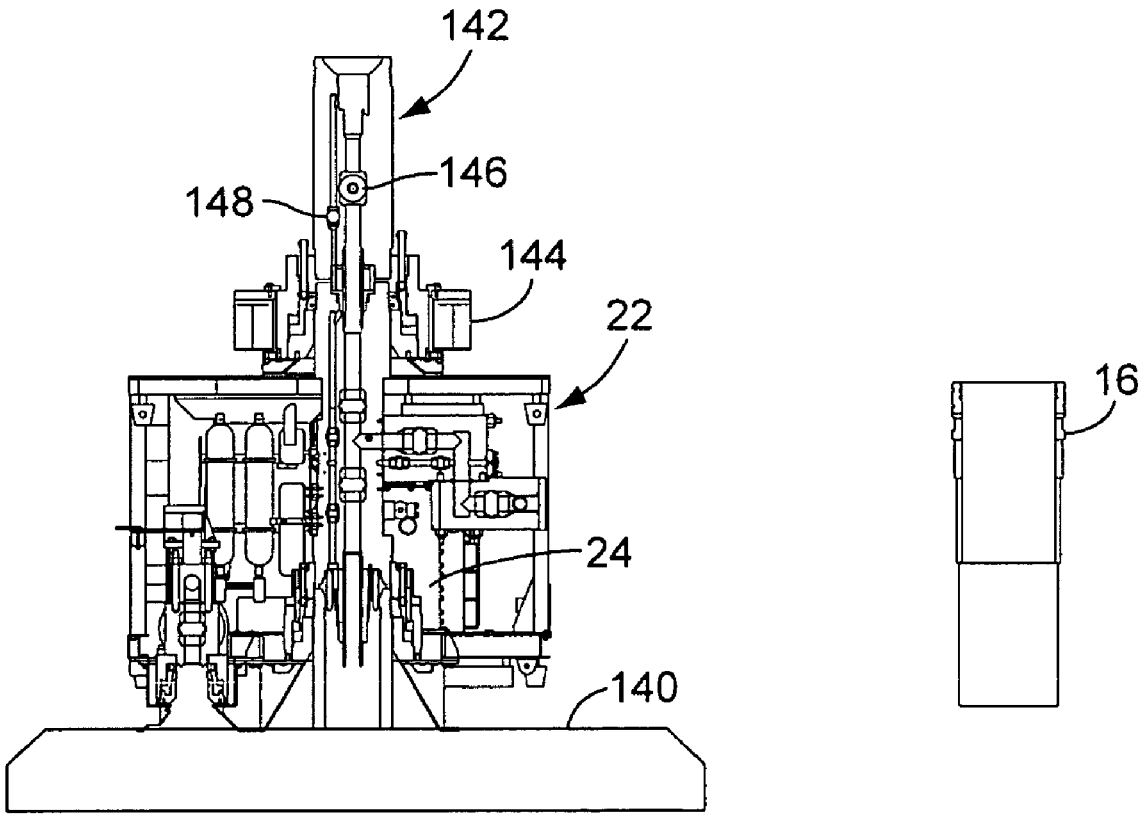
FIGS. 12A through 12J illustrate the sequence of steps for installing the subsea completion system of FIG. 1 in accordance with another embodiment of the present invention.

The sequence of steps for installing the conventional completion system 10 in accordance with another embodiment of the present invention is illustrated in FIGS. 12A through 12J. Referring to FIG. 12A, the conductor housing 16 is installed as in the previous embodiment, after which the mudmat 94, the christmas tree 22, and a tree adapter 142 are lowered as a unit to a location on the sea floor proximate the well. The tree adapter 142 is connected to the christmas tree 22 via a conventional connector 144, and the christmas tree is connected to the mudmat 140 via the connector 24. The tree adapter may include a production bore valve 146 and/or and an annulus valve 148. At this point, installation of the completion system 10 proceeds as in the previous embodiment up to and including the step of retrieving the THRT 96.

Figure 12B:
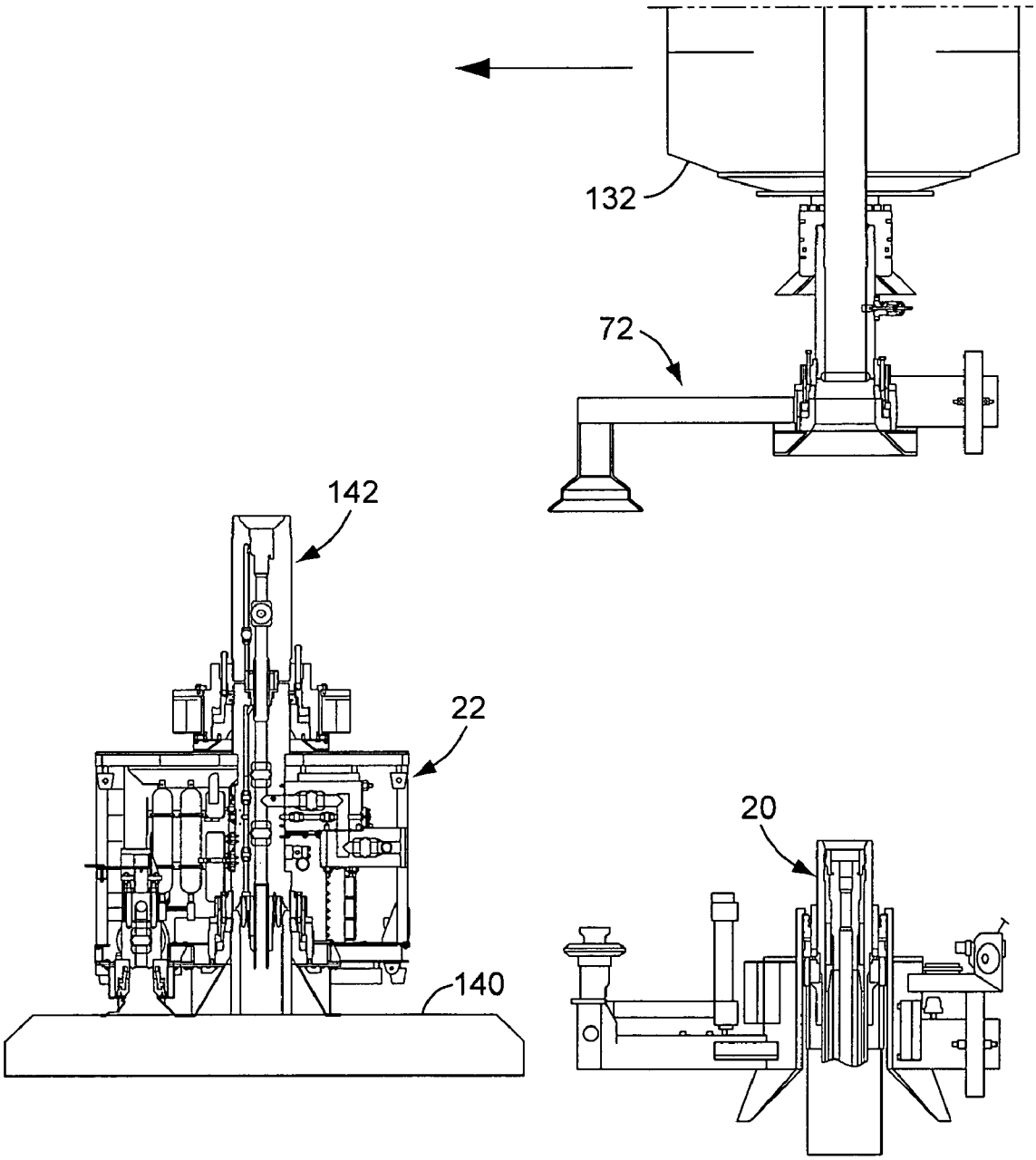
Figure 12C:
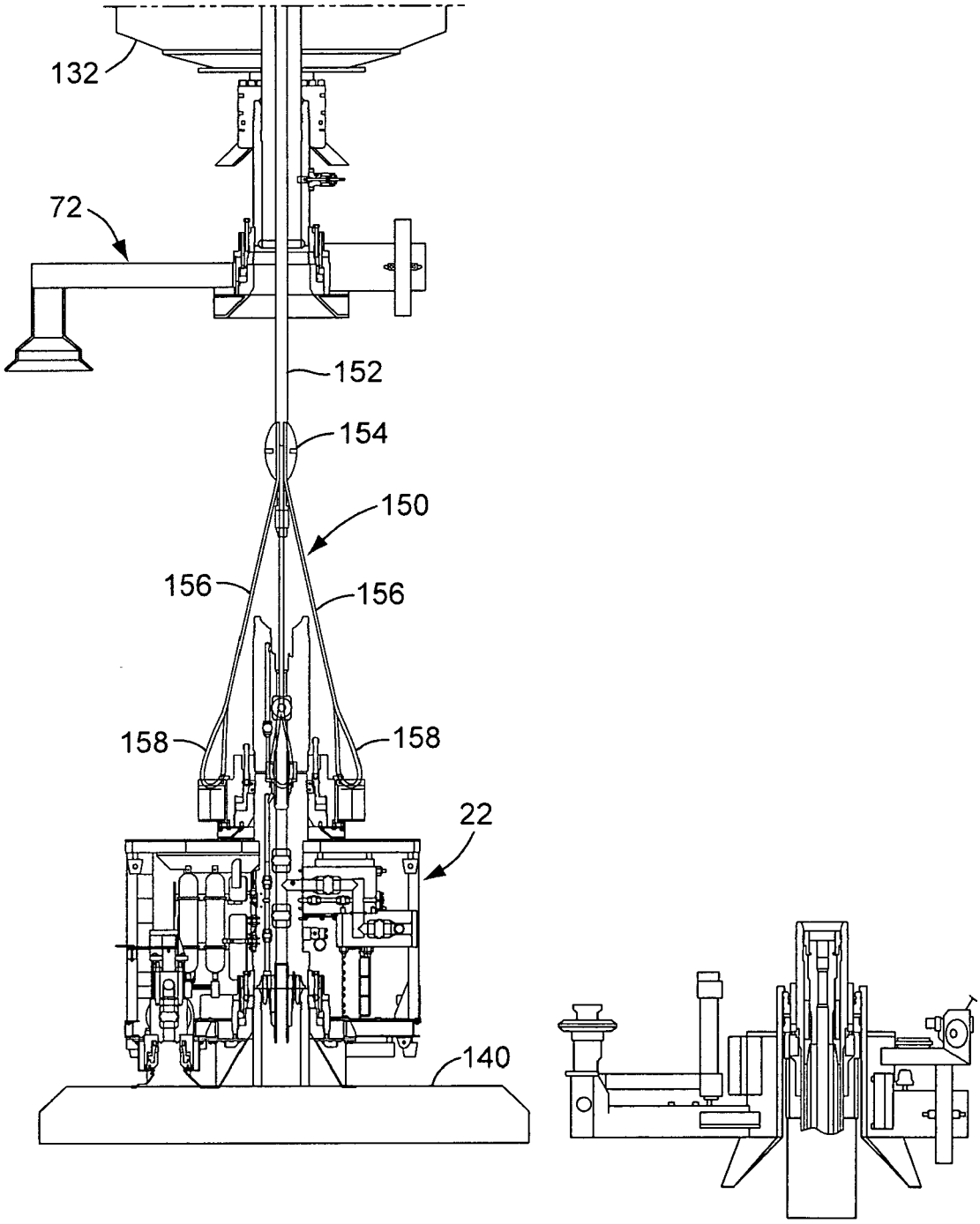

Referring to FIG. 12B, after the THRT 96 has been retrieved, the THOT 72 is disconnected from wellhead 20 and the BOP 132 and the THOT are raised together using, for example, the riser tensioners on the vessel or platform. The drilling rig is then translated or skidded over until the BOP 132 and the THOT 72 are above the tree adapter 142. As shown in FIG. 12C, with the BOP 132 and the THOT 72 in this position, a lifting sling 150 is deployed via a drill string 152 and a drill string adapter 154. The lifting sling 150 comprises several lengths of cable 156 which terminate in cable loops 158. An ROV is used to attach the loops 158 to hooks or other suitable connection means located on the tree adapter 142.

Figure 12D:
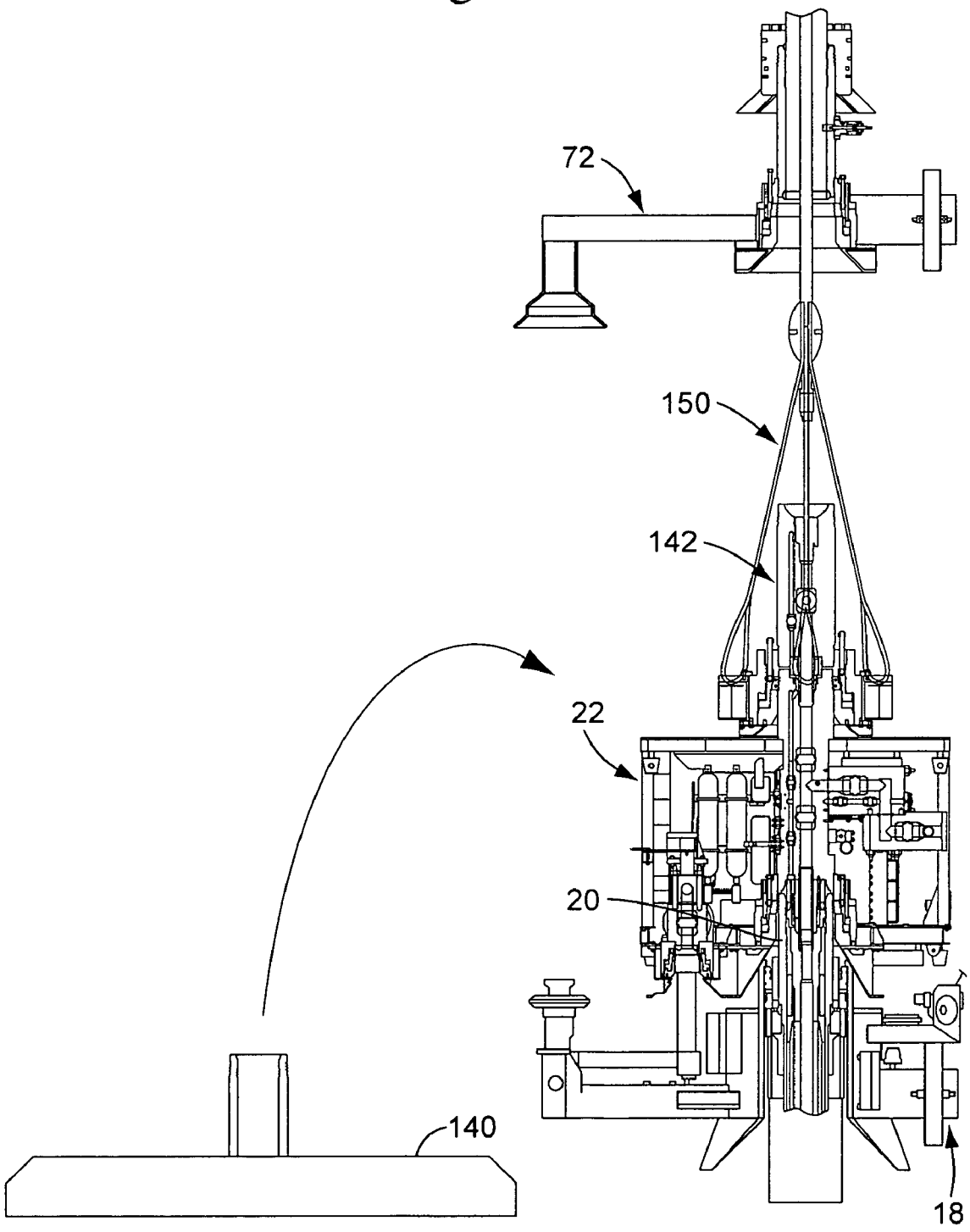
Figure 12E:
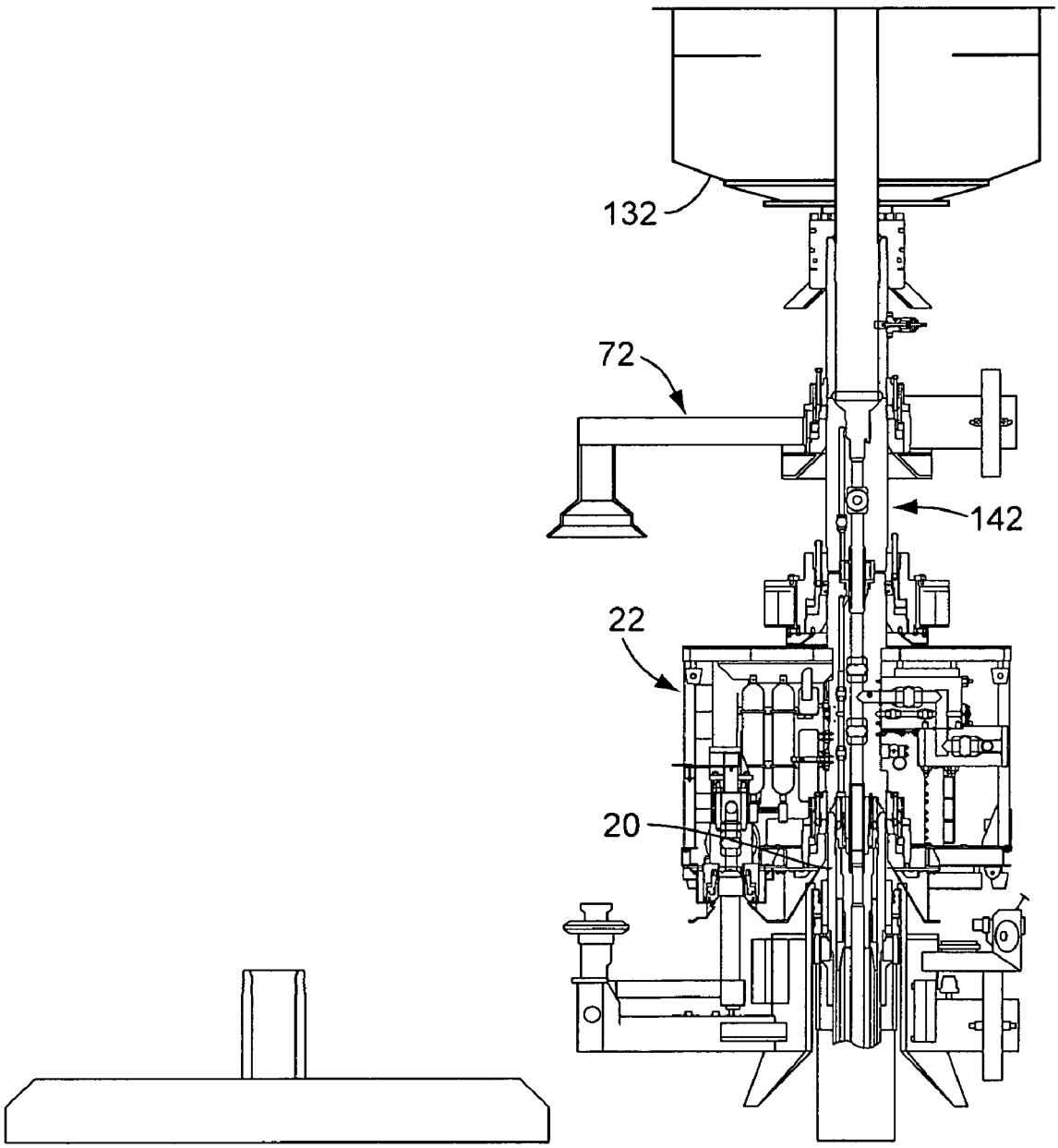
Figure 12F:
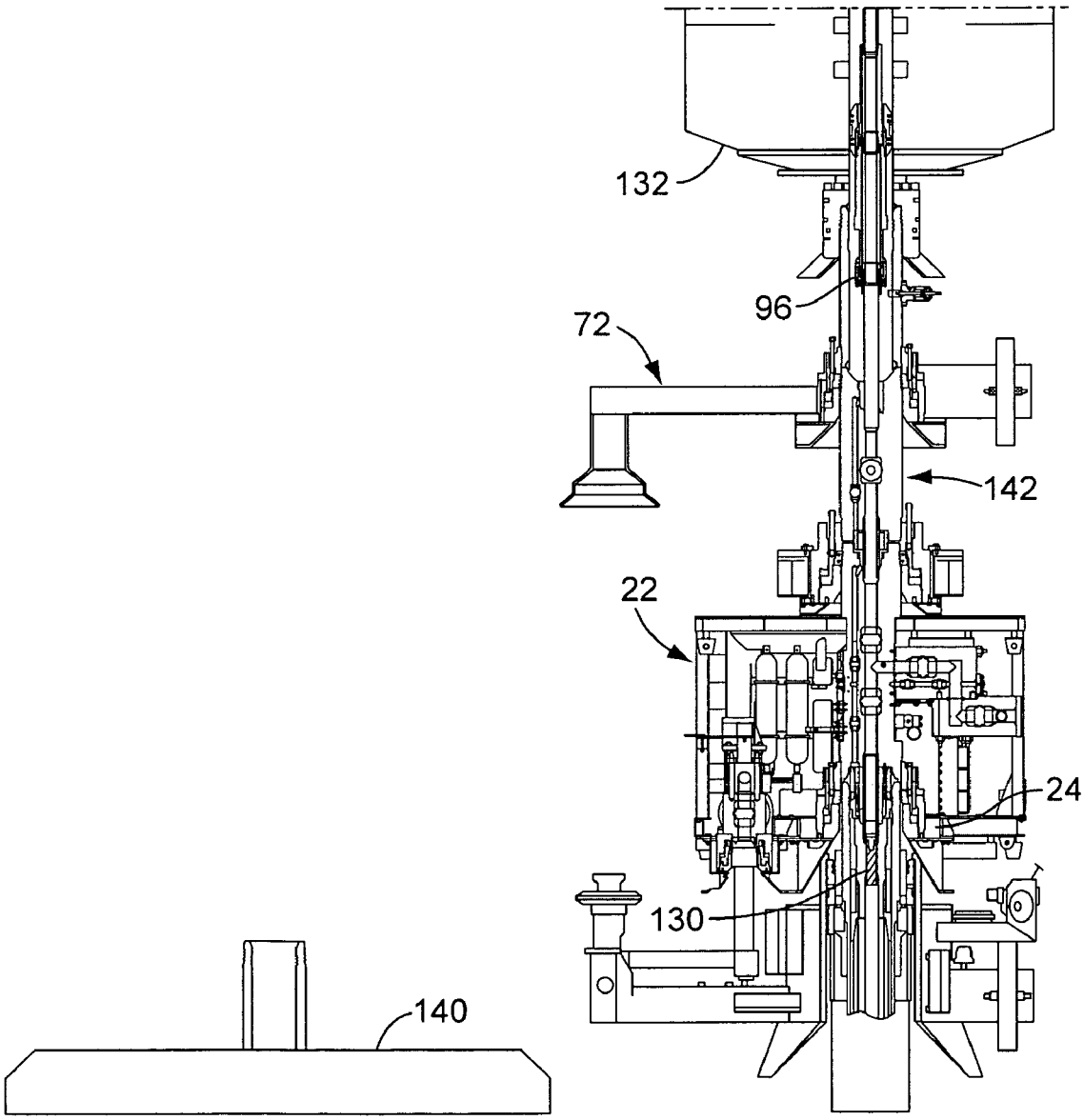

Referring to FIG. 12D, the christmas tree 22 is then disconnected from mudmat 140, and the christmas tree and the tree adapter 142 are moved to and lowered onto the wellhead 20. An ROV may then be used to orient the christmas tree relative to the CGB 18. Once the christmas tree 22 is secured to the wellhead 20, the lifting sling 150 is disconnected and retrieved. As shown in FIG. 12E, the BOP 132 and the THOT 72 are then lowered onto the tree adapter 142 and the THOT 72 is connected to the tree adapter. As shown in FIG. 12F, the THRT 96 is then lowered and connected to the top of the tree adapter 142. The tree connector 24 and any other downhole connections may now be locked and tested, and the wireline plug 130 may be retrieved from the tubing hanger 48. The well can now be flow tested back to the drilling rig.

Figure 12G:
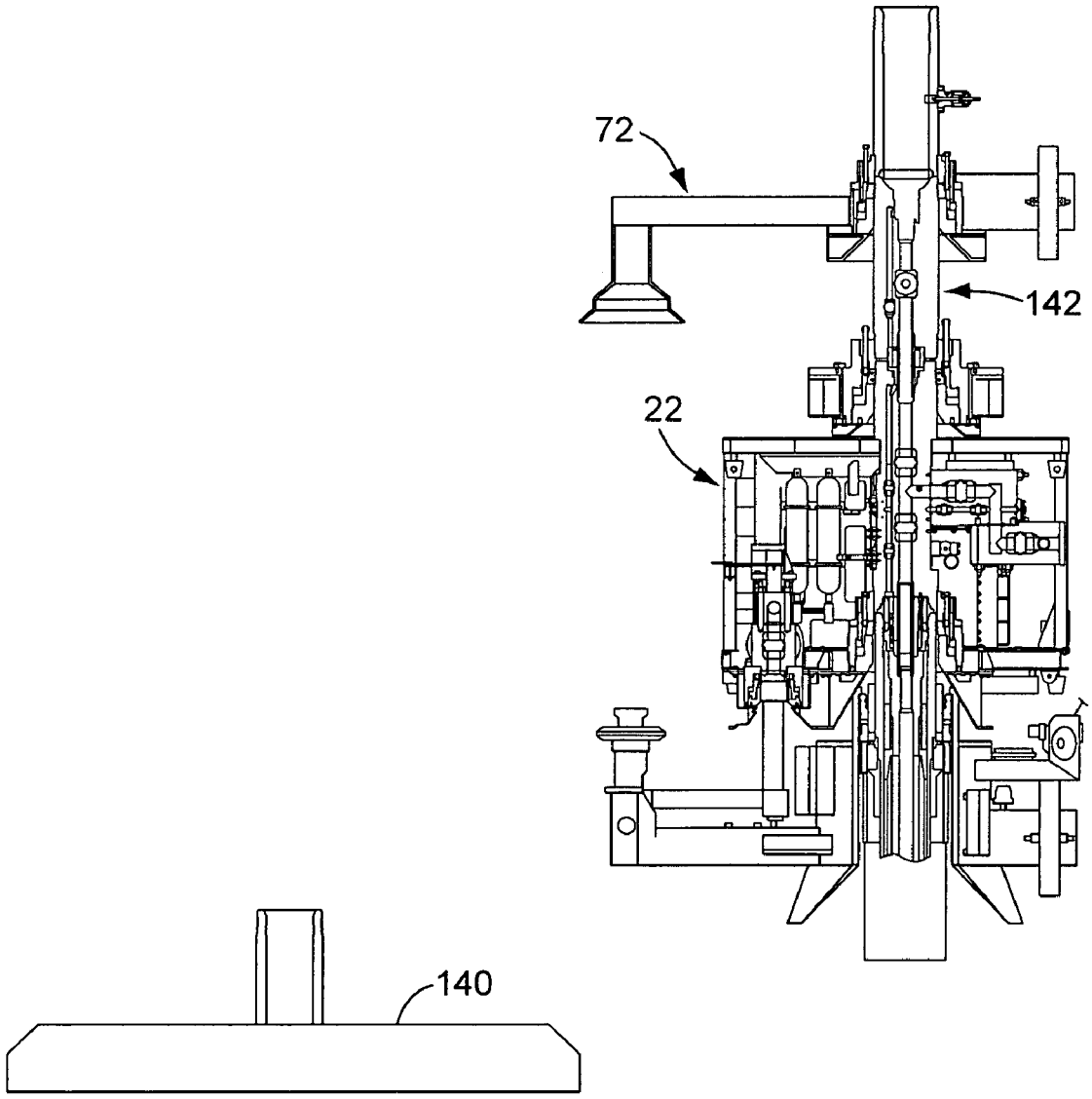
Figure 12H:
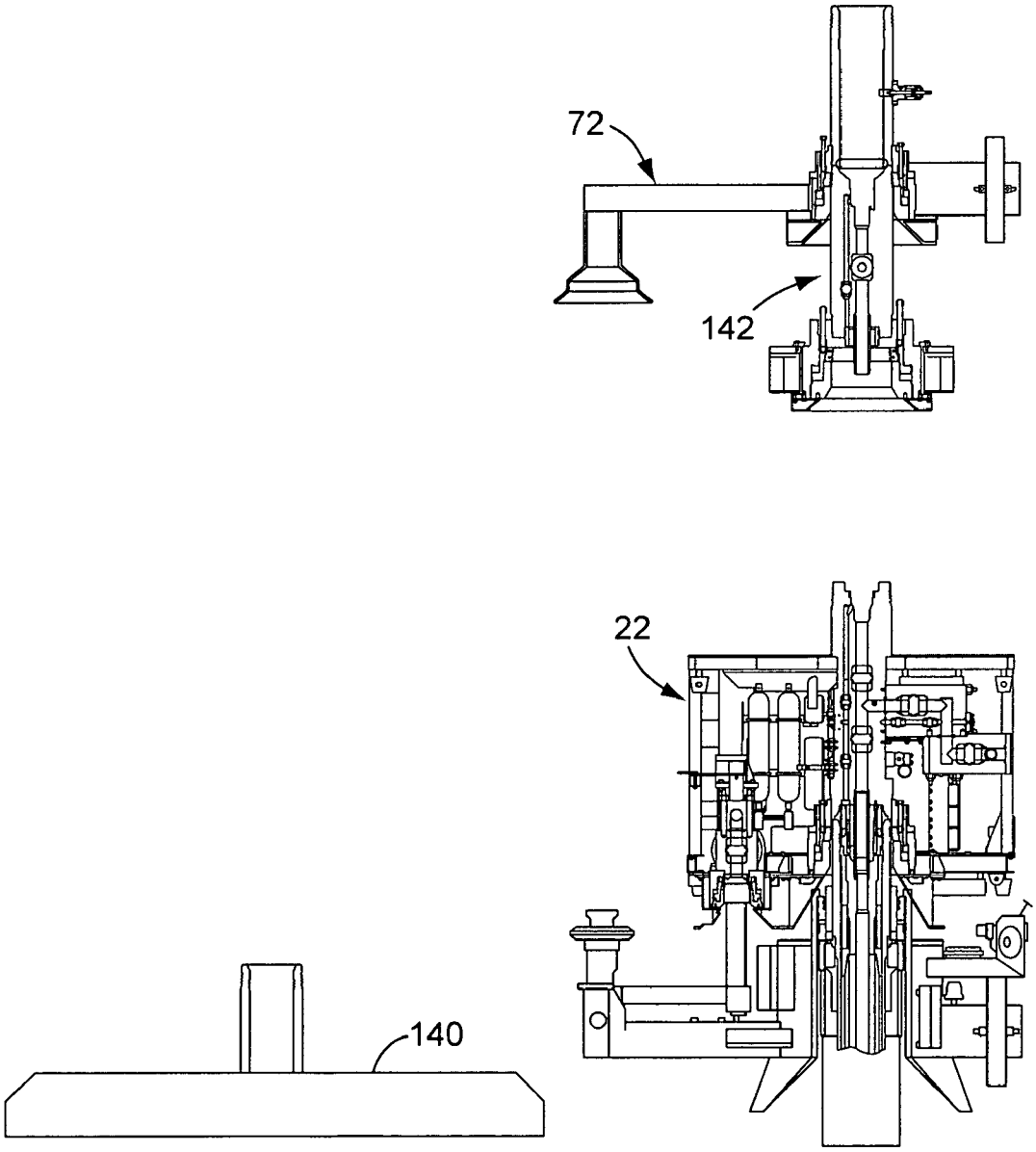

Referring to FIG. 12G, once the well has been flow tested, the THRT 96 and the BOP 132 are retrieved to the surface. Alternatively the BOP 132 could be moved to another well. As shown in FIG. 12H, tree adapter 142 is then disconnected from the christmas tree 22, and the THOT 72 and the tree adapter 142 are retrieved to the surface.

Figure 12I:
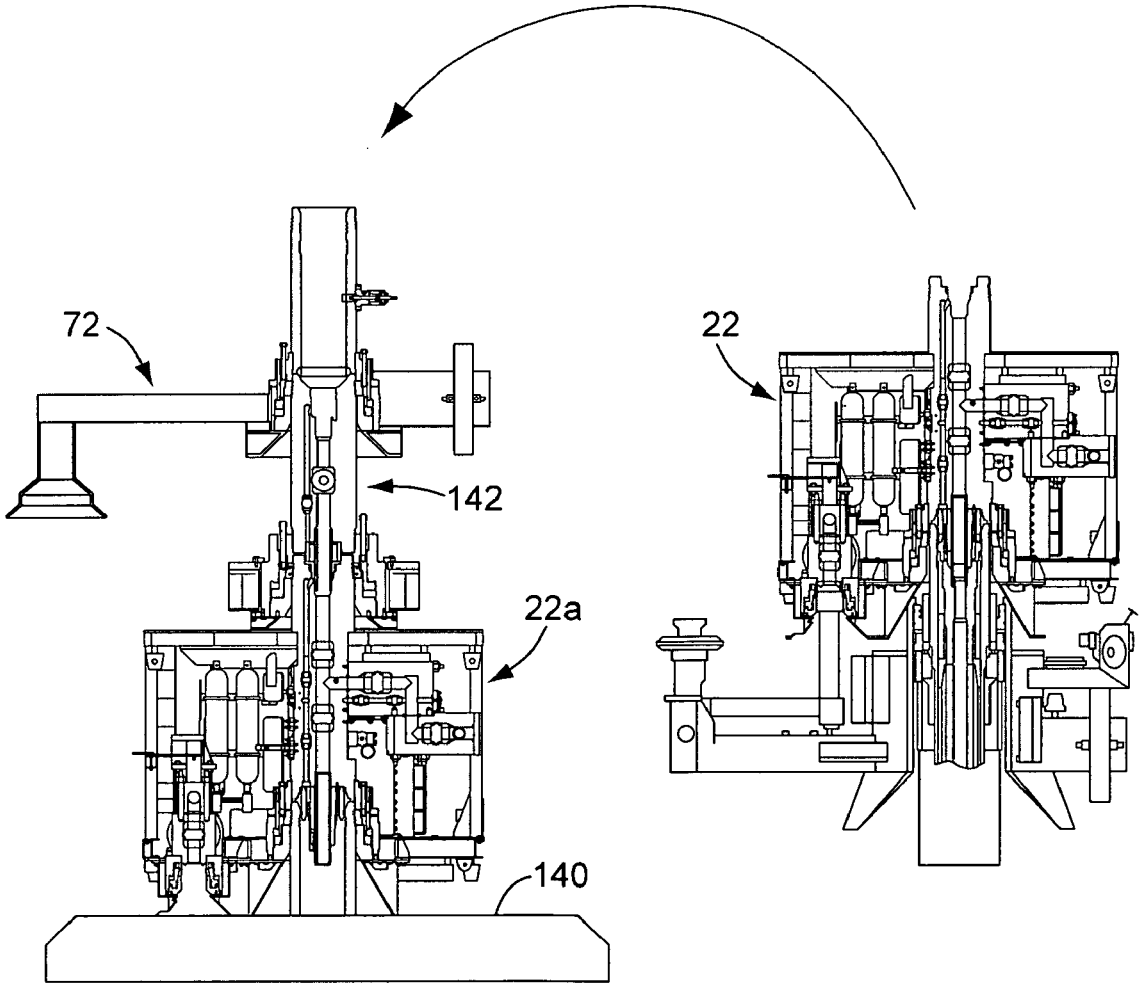
Figure 12J:
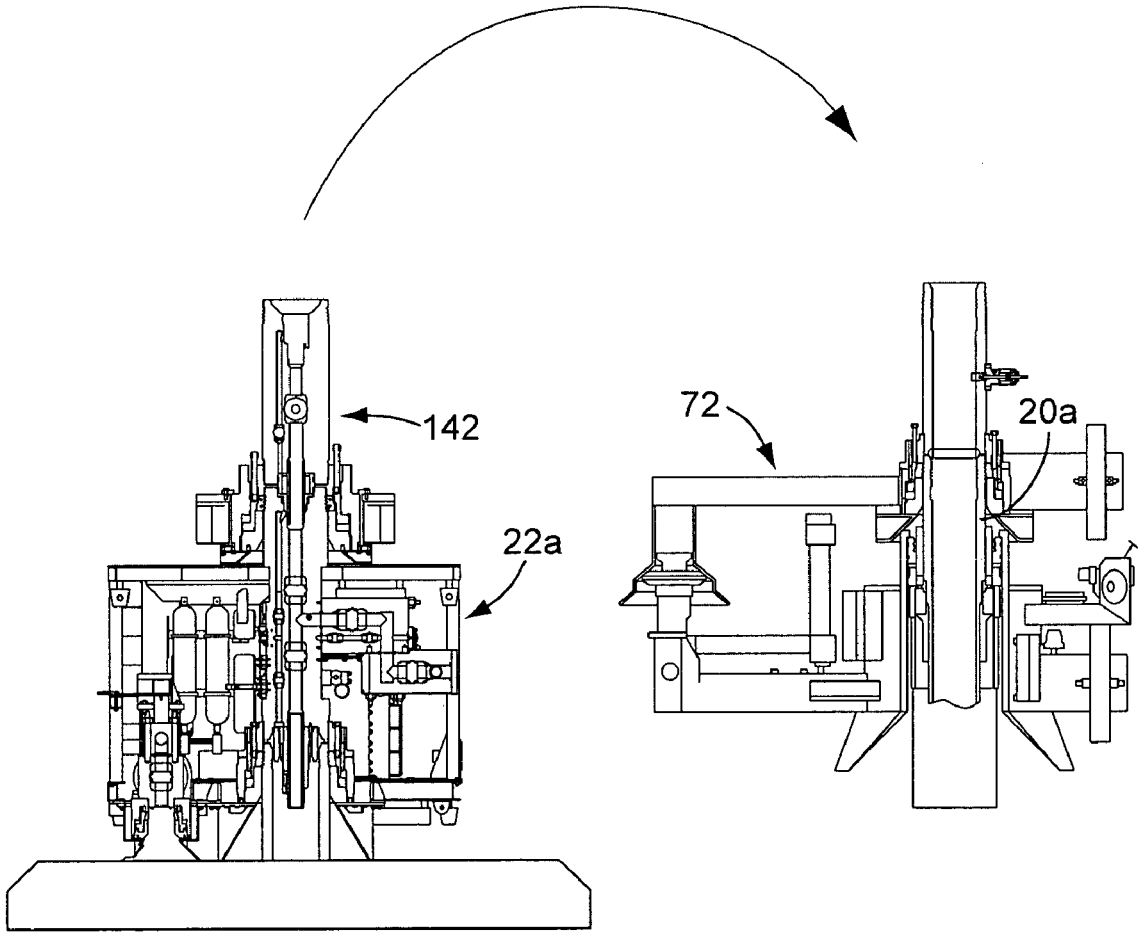

Alternatively, as shown in FIG. 12I, the THOT 72 and the tree adapter 142 can be moved to a second tree 22*a* which has been wet parked on the mudmat 140. As shown in FIG. 12J, the THOT 72 is then disconnected from the adapter 142 and moved to a second wellhead 20*a*. Alternatively, the THOT 72 could be retrieved to the surface.

The apparatus and methods of present invention can be used in conjunction with the systems, components, and/or methods disclosed in U.S. Pat. Nos. 6,408,947 and 6,227,300 and U.S. patent application Ser. No. 09/685,407, which are commonly owned herewith and are hereby incorporated herein by reference.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

I claim:

1. A method for installing a subsea completion system over a well bore, the subsea completion system comprising a wellhead which is installed at an upper end of the well bore; a tubing hanger which comprises at least one tubing hanger bore, and a christmas tree which comprises at least one christmas tree bore, the method comprising the steps of:

(a) landing the tubing hanger in the wellhead;

(b) installing a plug in the tubing hanger bore;

(c) providing a tree adapter which comprises a production bore and a valve for controlling flow through the production bore;

(d) connecting the tree adapter to the christmas tree with the production bore in alignment with the christmas tree bore;

(e) connecting the christmas tree to the wellhead with the christmas tree bore in alignment with the tubing hanger bore;

(f) connecting a tubing hanger running tool (THRT) to the tree adapter; and (g) removing the plug from the tubing hanger bore through the THRT, the production bore and the christmas tree bore.

2. The method of claim 1, further comprising the steps of disconnecting the tree adapter from the christmas tree and retrieving the THRT and the tree adapter to a surface facility.

3. The method of claim 1, further comprising the step of lowering the christmas tree from a surface facility to a location proximate the wellhead on at least one of a cable and a drill string.

4. The method of claim 3, wherein the tree adapter is connected to the christmas tree at the surface facility and the tree adapter and the christmas tree are lowered together to the location proximate the wellhead.

5. The method of claim 4, further comprising the step of connecting a blowout preventer (BOP) to the wellhead prior to the step of landing the tubing hanger in the wellhead.

6. The method of claim 5, further comprising the steps of:

disconnecting the BOP from the wellhead;

positioning the BOP over the tree adapter and the christmas tree;

lowering a lifting sling through the BOP;

securing the lifting sling to at least one of the tree adapter and the christmas tree;

using the lifting sling, positioning the tree adapter and the christmas tree over the wellhead; and connecting the christmas tree to the wellhead.

7. The method of claim 6, further comprising the steps of:

retrieving the lifting sling;

connecting the BOP to the tree adapter; and lowering the THRT through the BOP prior to connecting the THRT to the tree adapter.

8. The method of claim 7, further comprising the following steps after the plug has been removed from the tubing hanger bore:

retrieving the THRT to the surface facility;

disconnecting the BOP from the tree adapter; and disconnecting the tree adapter from the christmas tree.

9. The method of claim 8, further comprising the step of retrieving the BOP to the surface facility.

10. The method of claim 8, further comprising the step of moving the BOP to a second wellhead.

11. The method of claim 8, further comprising the step of retrieving the tree adapter to the surface facility.

12. The method of claim 8, further comprising the step of moving the tree adapter to a second christmas tree.

13. The method of claim 1, wherein the wellhead is installed in a conductor housing and the method further comprises the steps of:

mounting a completions guide base (CGB) to the conductor housing; and orienting the tubing hanger relative to the CGB.

14. The method of claim 13, wherein the step of orienting the tubing hanger relative to the CGB comprises the steps of:

landing a tubing hanger orientation tool (THOT) on the wellhead;

orienting the THOT relative to the CGB; and orienting the tubing hanger relative to the THOT.

15. The method of claim 14, further comprising the step of orienting the christmas tree relative to the CGB prior to the step of connecting the christmas tree to the wellhead.

16. A method for installing a subsea completion system which comprises the steps of:

(a) installing a conductor housing on the sea floor;

(b) installing a wellhead in the conductor housing;

(c) connecting a blowout preventer (BOP) to the wellhead;

(d) connecting a tubing hanger running tool (THRT) to a tubing hanger which comprises a tubing hanger bore;

(e) landing the tubing hanger in the wellhead through the BOP;

(f) installing a plug in the tubing hanger bore through the THRT;

(g) retrieving the THRT;

(h) disconnecting the BOP from the wellhead;

(i) providing a tree adapter which comprises a production bore and a valve for controlling flow through the production bore;

(j) providing a christmas tree which comprises a christmas tree bore;

(k) connecting the tree adapter to the christmas tree with the production bore in alignment with the christmas tree bore;

(l) connecting the christmas tree to the wellhead with the christmas tree bore in alignment with the tubing hanger bore;

(m) connecting the BOP to the tree adapter;

(n) lowering the THRT through the BOP and connecting the THRT to the tree adapter; and (o) removing the plug from the tubing hanger bore through the THRT, the production bore and the christmas tree bore.

17. The method of claim 16, further comprising the step of lowering the christmas tree from a surface facility to a location proximate the wellhead on at least one of a cable and a drill string.

18. The method of claim 17, wherein the tree adapter is connected to the christmas tree at the surface facility and the tree adapter and the christmas tree are lowered together to the location proximate the wellhead.

19. The method of claim 18, further comprising the following steps after the BOP is disconnected from the wellhead:

positioning the BOP over the tree adapter and the christmas tree;

lowering a lifting sling through the BOP;

securing the lifting sling to at least one of the tree adapter and the christmas tree;

using the lifting sling, positioning the tree adapter and the christmas tree over the wellhead; and connecting the christmas tree to the wellhead.

20. The method of claim 19, further comprising the step of retrieving the lifting sling prior to the step of connecting the BOP to the tree adapter.

21. The method of claim 20, further comprising the following steps after the plug has been removed from the tubing hanger bore:

retrieving the THRT to the surface facility;

disconnecting the BOP from the tree adapter; and disconnecting the tree adapter from the christmas tree.

22. The method of claim 21, further comprising the step of retrieving the BOP to the surface facility.

23. The method of claim 21, further comprising the step of moving the BOP to a second wellhead.

24. The method of claim 21, further comprising the step of retrieving the tree adapter to the surface facility.

25. The method of claim 21, further comprising the step of moving the tree adapter to a second christmas tree.

26. The method of claim 16, further comprising the steps of:

mounting a completions guide base (CGB) to the conductor housing; and orienting the tubing hanger relative to the CGB.

27. The method of claim 26, wherein the step of orienting the tubing hanger relative to the CGB comprises the steps of:

landing a tubing hanger orientation tool (THOT) on the wellhead;

orienting the THOT relative to the CGB; and orienting the tubing hanger relative to the THOT.

28. The method of claim 26, further comprising the step of orienting the christmas tree relative to the CGB prior to the step of connecting the christmas tree to the wellhead.

* * * * *